US012383028B2

(12) United States Patent
Aceves Tinajero et al.

(10) Patent No.: US 12,383,028 B2
(45) Date of Patent: Aug. 12, 2025

(54) SUSTAINABLE FOOTWEAR ARTICLE

(71) Applicant: NIKE, Inc., Beaverton, OR (US)

(72) Inventors: Juan L. Aceves Tinajero, Beaverton, OR (US); Samuel L. Bartys, London (GB); Michele Galasso, Portland, OR (US); Rosa H. Kim, Beaverton, OR (US); Darryl Matthews, Portland, OR (US); Shamees Mohamed, Portland, OR (US); William Moroski, Portland, OR (US); Yukiko Toyoda, Portland, OR (US); Yang Zhao, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 35 days.

(21) Appl. No.: 18/121,365

(22) Filed: Mar. 14, 2023

(65) Prior Publication Data

US 2023/0292883 A1 Sep. 21, 2023

Related U.S. Application Data

(60) Provisional application No. 63/320,078, filed on Mar. 15, 2022, provisional application No. 63/320,125, filed on Mar. 15, 2022.

(51) Int. Cl.
*A43B 3/24* (2006.01)
*A43B 1/00* (2006.01)
(Continued)

(52) U.S. Cl.
CPC ..... *A43B 23/0215* (2013.01); *A43B 1/0063* (2013.01); *A43B 1/04* (2013.01); *A43B 3/24* (2013.01); *A43B 23/0205* (2013.01)

(58) Field of Classification Search
CPC ..... A43B 7/04; A43B 23/0205; A43B 3/24; A43B 3/244; A43B 13/36; A43B 1/0063
(Continued)

(56) References Cited

U.S. PATENT DOCUMENTS 1,910,251 A * 5/1933 Joha ..... A43B 1/04 36/11
2,047,724 A * 7/1936 Zuckerman ..... A43B 1/04 36/11
(Continued)

FOREIGN PATENT DOCUMENTS

CN 107348601 A 11/2017
FR 2856251 B1 9/2005
(Continued)

OTHER PUBLICATIONS

Invitation to Pay Additional Fees received for PCT Patent Application No. PCT/US2023/015262, mailed on May 30, 2023, 11 pages.
(Continued)

*Primary Examiner* — Marie D Bays
(74) *Attorney, Agent, or Firm* — Shook, Hardy & Bacon L.L.P.

(57) ABSTRACT

Articles of footwear for sustainable systems are disclosed herein. A modular article of footwear includes a knitted upper component and a midsole component that are removably secured together. Some aspects further includes an exterior sole component that is removably secured to the midsole component and the knitted upper component.

24 Claims, 25 Drawing Sheets

(51) Int. Cl.
*A43B 1/04* (2022.01)
*A43B 23/02* (2006.01)

(58) Field of Classification Search
USPC ..... 36/45, 50.1, 100
See application file for complete search history.

(56) References Cited

U.S. PATENT DOCUMENTS

| | | | | |
|---|---|---|---|---|
| 2,147,197 | A * | 2/1939 | Glidden | A43B 1/04 36/3 R |
| 2,495,984 | A | 1/1950 | Roy | |
| 2,677,825 | A | 5/1954 | Richardson et al. | |
| 3,650,051 | A | 3/1972 | Sass | |
| 4,272,859 | A | 6/1981 | Vanhove | |
| 4,354,319 | A | 10/1982 | Block et al. | |
| 4,422,249 | A | 12/1983 | Hannah | |
| 4,489,509 | A | 12/1984 | Libit | |
| 5,291,671 | A | 3/1994 | Caberlotto et al. | |
| 5,379,615 | A | 1/1995 | Shima | |
| 6,941,681 | B2 | 9/2005 | Pritchett | |
| 7,793,435 | B1 | 9/2010 | Ruth | |
| 8,037,621 | B2 | 10/2011 | Hooper | |
| 8,074,379 | B2 | 12/2011 | Robinson et al. | |
| D651,380 | S | 1/2012 | Wilcots | |
| 8,225,530 | B2 | 7/2012 | Sokolowski et al. | |
| 8,307,570 | B2 | 11/2012 | Delgatty | |
| 8,850,721 | B2 | 10/2014 | Long et al. | |
| 8,984,694 | B2 | 3/2015 | Teichert et al. | |
| 9,414,641 | B2 | 8/2016 | Ellis | |
| 9,468,253 | B2 | 10/2016 | Floriot Godin | |
| 9,861,161 | B2 | 1/2018 | Meschter et al. | |
| 9,877,536 | B2 | 1/2018 | Huffman et al. | |
| 9,936,757 | B2 | 4/2018 | Podhajny | |
| 9,955,748 | B2 | 5/2018 | Grove et al. | |
| 10,264,848 | B2 | 4/2019 | Elder et al. | |
| 10,435,825 | B2 | 10/2019 | Macgilbert et al. | |
| 10,721,989 | B2 | 7/2020 | Jenkins et al. | |
| 11,058,179 | B2 | 7/2021 | Woodard | |
| 2004/0148803 | A1* | 8/2004 | Grove | A43B 23/0245 36/31 |
| 2004/0181972 | A1 | 9/2004 | Csorba | |
| 2004/0255486 | A1* | 12/2004 | Pawlus | A43B 19/00 36/114 |
| 2007/0227045 | A1* | 10/2007 | Aveni | A43B 3/24 36/8.3 |
| 2008/0168681 | A1* | 7/2008 | Andersen | A43B 13/12 36/15 |
| 2009/0183392 | A1* | 7/2009 | Shane | A43B 3/244 12/114.2 |
| 2014/0130376 | A1* | 5/2014 | Fahmi | D04B 1/123 36/84 |
| 2014/0259779 | A1* | 9/2014 | Hashish | A43B 13/04 12/142 R |
| 2015/0007457 | A1* | 1/2015 | Orza | A43B 7/149 36/102 |
| 2015/0289579 | A1* | 10/2015 | Meir | A43B 23/027 36/9 R |
| 2016/0174661 | A1* | 6/2016 | Nonogawa | A43B 23/0235 36/88 |
| 2016/0324264 | A1* | 11/2016 | Johnson | A43B 3/244 |
| 2017/0079370 | A1 | 3/2017 | Hashish et al. | |
| 2018/0103714 | A1* | 4/2018 | Howe | A43B 7/081 |
| 2018/0160774 | A1 | 6/2018 | Terai et al. | |
| 2018/0343973 | A1 | 12/2018 | Hancock | |
| 2019/0037968 | A1 | 2/2019 | Dewillie et al. | |
| 2019/0037970 | A1 | 2/2019 | Klug et al. | |
| 2019/0142112 | A1* | 5/2019 | Ramsay | A43B 3/24 36/50.1 |
| 2019/0309453 | A1* | 10/2019 | Dua | A43B 1/04 |
| 2019/0343216 | A1 | 11/2019 | Huffa et al. | |
| 2020/0046078 | A1* | 2/2020 | Durrell | D04B 1/123 |
| 2020/0187595 | A1* | 6/2020 | Siegismund | A43B 1/04 |
| 2020/0205515 | A1 | 7/2020 | Cross et al. | |
| 2021/0022447 | A1 | 1/2021 | Cobb | |
| 2021/0120915 | A1 | 4/2021 | Panian | |
| 2021/0219661 | A1* | 7/2021 | Line | D04B 1/123 |
| 2021/0298422 | A1* | 9/2021 | Kajiwara | A43B 7/125 |
| 2021/0345728 | A1 | 11/2021 | Fox | |
| 2023/0292877 | A1* | 9/2023 | Galasso | A43B 23/0245 36/15 |
| 2023/0292883 | A1* | 9/2023 | Aceves Tinajero | A43B 1/04 36/45 |

FOREIGN PATENT DOCUMENTS

| | | | |
|---|---|---|---|
| TW | 201517825 | A | 5/2015 |
| TW | M573965 | U | 2/2019 |
| TW | 202027638 | A | 8/2020 |
| TW | M652045 | U | 3/2024 |
| WO | 98/35573 | A1 | 8/1998 |
| WO | 2015/116293 | A1 | 8/2015 |
| WO | 2016/115156 | A1 | 7/2016 |
| WO | 2016/115157 | A1 | 7/2016 |
| WO | 2018/133646 | A1 | 7/2018 |
| WO | 2019/001676 | A1 | 1/2019 |

OTHER PUBLICATIONS

Burns, Chris, "Straw Sneakers", Yanko Design, Available online at: <https://www.yankodesign.com/2009/10/28/straw-sneakers/>, Oct. 28, 2009, 3 pages.

Kittner, Markus, "MODUL-R Knitted Footwear—Part 1 The Concept", 74 Footwear Design Consulting, Available online at: <https://74fdc.wordpress.com/2015/06/21/knitted-footwear-an-advanced-design-for-effective-recycling-separation/>, Jun. 21, 2015, 3 pages.

International Search Report and Written Opinion received for PCT Patent Application No. PCT/US2023/015262, mailed on Jul. 21, 2023, 16 pages.

* cited by examiner

SUSTAINABLE FOOTWEAR ARTICLE

CROSS-REFERENCE TO RELATED APPLICATIONS

This Nonprovisional Application claims priority to U.S. Provisional Application No. 63/320,078, filed Mar. 15, 2022, and titled "Sustainable Footwear Article", which is related to U.S. Provisional Application No. 63/320,125, filed Mar. 15, 2022, and titled "Articles of Footwear Having Modular, Replaceable, and/or Recyclable Parts", the entire contents of both of which are incorporated by reference herein in their entireties.

TECHNICAL FIELD

Aspects herein relate to a sustainable article of footwear with a upper component formed of a knitted component and one or more sole components.

BACKGROUND

Conventional articles of footwear generally include an upper component and a sole component. The upper component is secured to the sole component and forms an interior chamber within the article of footwear for comfortably and securely receiving a foot. The upper component of the article of footwear generally extends over the instep and toe areas of the foot, along the medial and lateral sides of the foot, and around the heel area of the foot. Access to the interior chamber of the upper component cis generally provided by an ankle opening in a heel area of the footwear. A lacing system is often incorporated into the upper to adjust the fit of the upper, thereby facilitating entry and removal of the foot from the chamber within the upper.

Upper and sole components of conventional articles of footwear are often secured together using adhesive, stitching, or a combination thereof. In this way, they cannot easily be deconstructed into separate parts or easily recycled. In other words, when one component of the article of footwear becomes worn down, the entire article is replaced instead of a single component. Additionally, even where a use of an entire article of footwear is no longer desired, materials traditionally used to secure the upper and sole components together often impede easy recycling of the article of footwear. This impediment may be due to the materials themselves not being recyclable or due to the additional effort to separate the components, which are often made of different types of materials and are recycled according to different processes.

BRIEF DESCRIPTION OF THE DRAWINGS

This technology is described in detail herein with reference to the attached drawing figures, which are incorporated herein by reference, wherein.

DETAILED DESCRIPTION

Figure 1A:
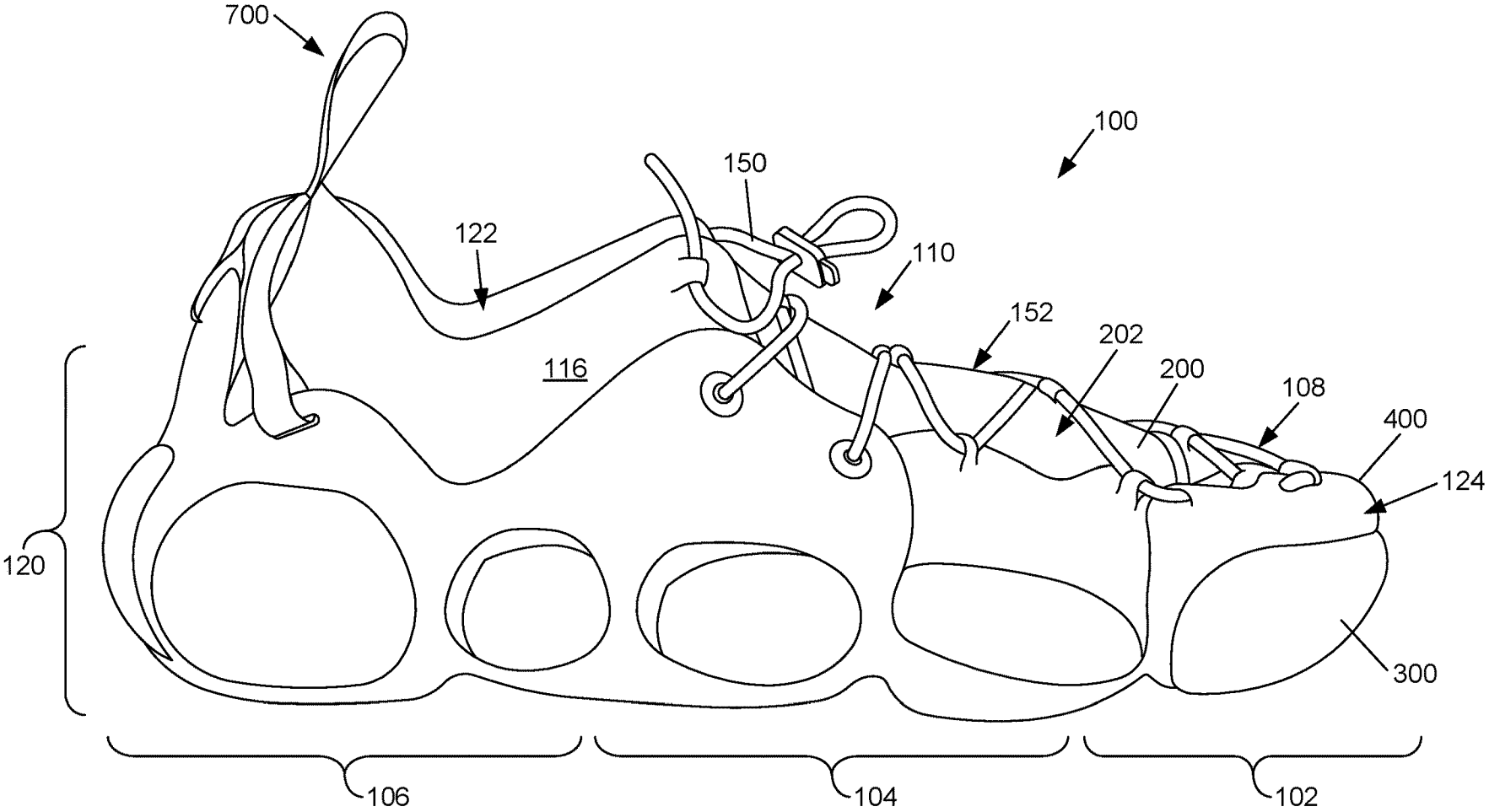
FIGS. 1A and 1B depict side views of an article of footwear in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

As described, certain aspects of the present disclosure relate to articles of footwear or aspects thereof. The term "article of footwear" or "footwear article" or "footwear" refers to any type of wearable apparel for the feet, including any shoe or boot. Illustrative, non-limiting examples of footwear includes athletic or sport-specific shoes, such as basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Example footwear may also include various types of non-athletic shoes, such as a dress shoe, a loafer, and a sandal. Accordingly, the concepts disclosed with respect to articles of footwear apply to a wide variety of footwear types.

Positional terms used when describing the article of footwear and components thereof, such as top, bottom, front, sides, back, superior, inferior, anterior, posterior, lateral, medial, right, left, interior, exterior, and the like, are used with respect to the article of footwear being worn as intended with the wearer standing upright such that the wearer's foot is in the foot-receiving chamber and the wearer's ankle or leg extends through the ankle opening. It should be understood, however, that use of positional terms do not depend on the actual presence of a human being for interpretative purposes.

The term "knitted upper component," as used herein, refers to a textile piece used for an upper that is formed from at least one yarn that is manipulated (e.g., with a knitting machine) to form a plurality of intermeshed loops that define courses and wales. The term "course," as used herein, refers to a predominantly horizontal row of knit loops (in an upright textile as knit) that are produced by adjacent needles during the same knitting cycle. The course may comprise one or more stitch types, such as a knit stitch, a held stitch, a float stitch, a tuck stitch, a transfer stitch, a rib stitch, and the like as these terms are known in the art of knitting. The term "knit stitch," as used herein, refers to the basic stitch type where the yarn is cleared from the needle after pulling a loop of the yarn from the back to the front of the textile through a previous stitch. The term "wale," as used herein, refers to a predominantly vertical column of intermeshed or interlooped knit loops, generally produced by the same needle at successive (but not necessarily all) courses or knitting cycles. The terms "horizontal" and "vertical" as used herein are relative to an upright textile as knit in which the heads of knit loops face toward the top of the textile and the course knit first is oriented towards the bottom of the textile.

The term "integrally knit," as used herein, refers to a knit textile (such as a knitted upper component) having a yarn from one or more knitted courses in a first area being interlooped with one or more knitted courses of another area. The interlooping may be through a simple knit stitch, a tuck stitch, a held stitch, a float or miss stitch, and the like. In this way, areas that are integrally knit together have a seamless transition.

There are various numerical measurements provided herein. Unless indicated otherwise, the term "about" or "substantially" with respect to a measurement means within ±10% of the indicated value.

FIGS. 1A and B depict a lateral side view and a medial side view, respectively, of an example article of footwear 100. The footwear 100 includes an upper 110 secured to a sole structure 120. The upper 110 may extend partially or completely around the foot of a wearer and may extend under the foot of a wearer. The footwear 100 may be divided into three general regions: a toe region 102, a midfoot region 104, and a heel region 106. The toe region 102 generally includes portions of the footwear 100 corresponding to the toes and joints connecting the metatarsals with the phalanges when the footwear 100 is worn. As described further herein, the toe region 102 may include an anterior portion 124 and a posterior portion 126. The midfoot region 104 generally includes portions of the footwear 100 corresponding with an arch of the foot when the footwear 100 is worn. The heel region 106 generally corresponds with rear portions of the foot, including the heel and calcaneus bone when the footwear 100 is worn. The footwear 100 also includes a lateral side 116 and a medial side 118, which may be defined by a longitudinal midline reference plane of the footwear 100. Each of the lateral side 116 and the medial side 118 extend through regions 102, 104, and 106, and correspond to opposite sides of the footwear 100. More particularly, the lateral side 116 corresponds with an outside area of the foot (i.e., the side that faces away from the other foot) when the footwear 100 is worn, while the medial side 118 corresponds with an inside area of the foot (i.e., the side that faces towards the other foot) when the footwear 100 is worn. These regions 102, 104, and 106 and sides 116 and 118 are not intended to demarcate precise areas of the footwear 100 but, rather, are intended to represent general areas of the footwear 100 to aid in understanding the various descriptions provided herein.

The sole structure 120 generally extends between the foot and the ground when the footwear 100 is worn. The sole structure 120 may be configured to attenuate forces, enhance stability and/or provide traction to the footwear 100. In exemplary aspects, the sole structure 120 includes a midsole component 300. Further, aspects may include an exterior sole component 400 that forms a ground-contacting surface. It should be understood that aspects of footwear 100 may exclude the exterior sole component 400 such that the midsole component 300 forms a ground-contracting surface. As such, any discussion of footwear 100 and components thereof that is not expressly limited to the exterior sole component 400 may be present in an aspect in which the exterior sole component is absent.

Additional sole components, such as an insole component (which also may be referred to as a sock liner), may be used. Various materials may be used to form the sole structure 120, such as rubber, ethylene vinyl acetate (EVA), thermoplastic polyurethane (TPU), thermoplastic elastomer (e.g., polyether block amide), and the like. In example aspects, the midsole component 300 and exterior sole component 400 provide sufficient protection, stability, and support without the need for a separate heel counter or toe cap. But it is contemplated that, in other aspects, additional features for attenuating forces, enhancing stability, and/or providing traction, like a heel counter or toe cap may be used without departing from the scope of this disclosure.

Figure 1B:
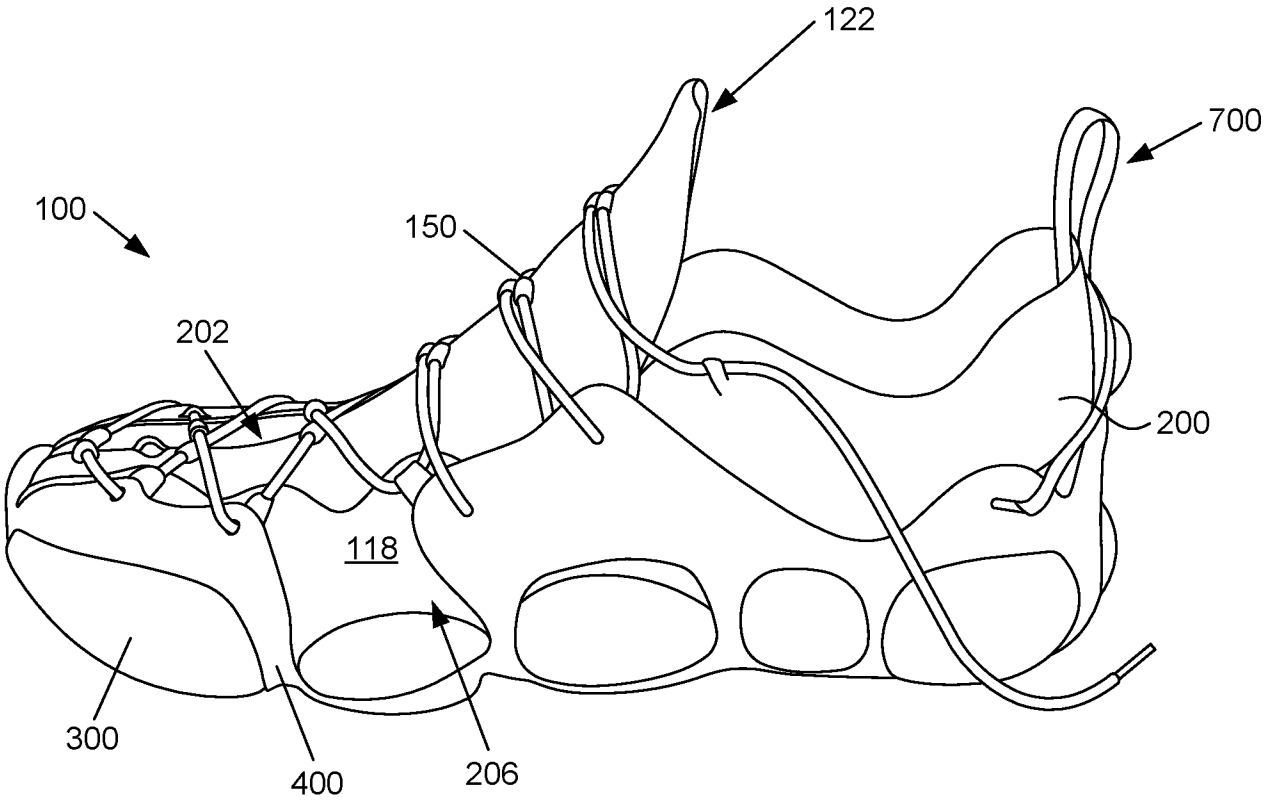

The upper 110 defines a chamber within the footwear 100 for receiving and securing a foot relative to the sole structure 120. Access to the chamber is provided by an ankle opening 122 located in at least the heel region 106. The size of the ankle opening 122 and fit of the upper 110 around a wearer's foot may be adjusted by a fastening system. The example fastening system depicted in FIGS. 1A and 1B include a lace 150 extending across a throat area 152.

At least a portion of the upper 110 may be formed of at least one knitted upper component 200. In some aspects, the entire upper 110 or substantially the entire the upper 110 is formed of the knitted upper component 200. The knitted upper component 200 may be formed as a single integral one-piece element during a knitting process, such as weft knitting, warp knitting, or any other suitable knitting process. Forming the upper 110 with the knitted upper component 200 may provide the upper 110 with advantageous characteristics including, but not limited to, a particular degree of elasticity, breathability, bendability, strength, moisture absorption, weight, abrasion resistance, and/or a combination thereof. Further, forming the upper 110 from an integrally knit knitted upper component 200 may enable formation of various features and structures of the upper 110 without the need for significant additional manufacturing steps or processes, thereby increasing production efficiency. Forming the upper 110 with the knitted upper component 200 may further increase the recyclability of the upper 110. The knitted upper component 200 may be formed entirely from material that is easily recyclable, such as a polyester yarn and because of the ability of the knitted upper component 200 to provide desired characteristics within the knitted component itself, the need to use additional components that may not be recyclable or as easily recyclable is removed.

In exemplary aspects, the upper 110 and sole structure 120 are coupled together without the use of adhesive or stitching to allow for easy deconstruction as well as construction of the footwear 100. Traditional footwear is typically made without the intention that a consumer would deconstruct the footwear and, as such, the upper and sole structure(s) of traditional footwear are typically secured together in a manner that inhibits deconstruction and reuse, such as through adhesives and/or stitching. In contrast, aspects of the footwear 100 are constructed in a way that allows for easy deconstruction for recycling and/or reusing components of the footwear 100, including the knitted upper component 200, the midsole component 300, and the exterior sole component 400. As such, the footwear 100 includes a mechanical engagement mechanism by which the knitted upper component 200, the midsole component 300, and the exterior sole component 400 are secured to one another through a mechanical interaction without the use of adhesives or stitching.

Figure 2:
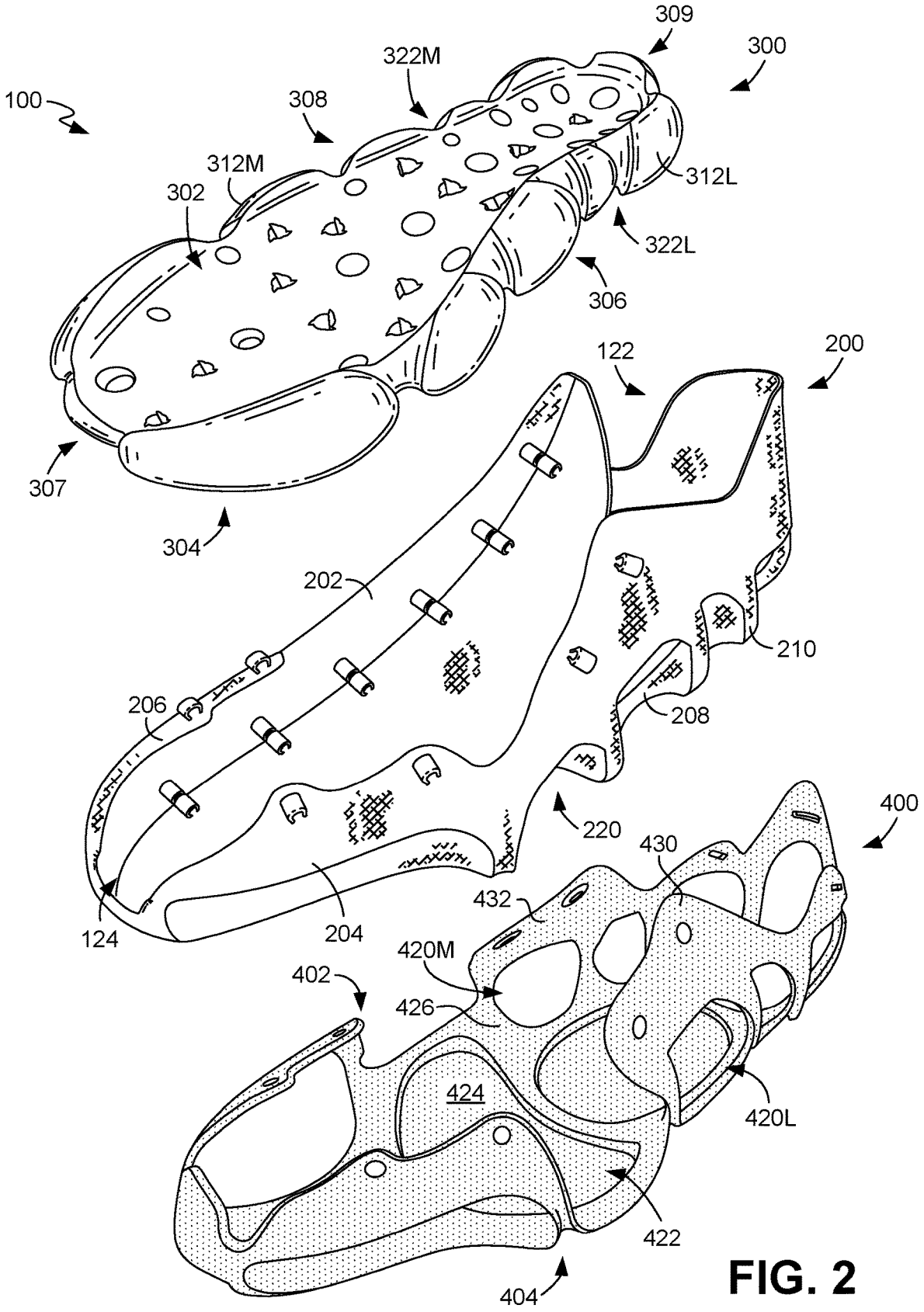
FIG. 2 depicts an exploded view of the article of footwear of FIGS. 1A and 1B in accordance with aspects herein.

In exemplary aspects and as described further with respect to FIGS. 2-8 below, protrusions in the midsole component 300 extend through openings in the knitted upper component 200 such that the knitted upper component 200 can lock around the midsole component 300, and the exterior sole component 400 may similarly engage with protrusions in the midsole component 300. For example, FIG. 2 depicts an exploded view of a the footwear 100 having the knitted upper component 200, the midsole component 300, the exterior sole component 400. The midsole component 300 may fit within a chamber of the knitted upper component 200 access through the ankle opening 122, which may be enlarged by pulling back on an overfoot knit panel 202 as described further herein. When the midsole component 300 is positioned inside the knitted upper component 200, protrusions (such as lateral-side protrusions 312L and medial-side protrusions 312M) on the midsole component 300 extend through openings 220 on the knitted upper component 200. The exterior sole component 400 may wrap around the combined knitted upper component 200 and midsole component 300. The lateral-side protrusions 312L and medial-side protrusions 312M of the midsole component 300 may extend through openings, such as lateral-side openings 420L and medial-side openings 420M of the exterior sole component 400.

Figure 3A:
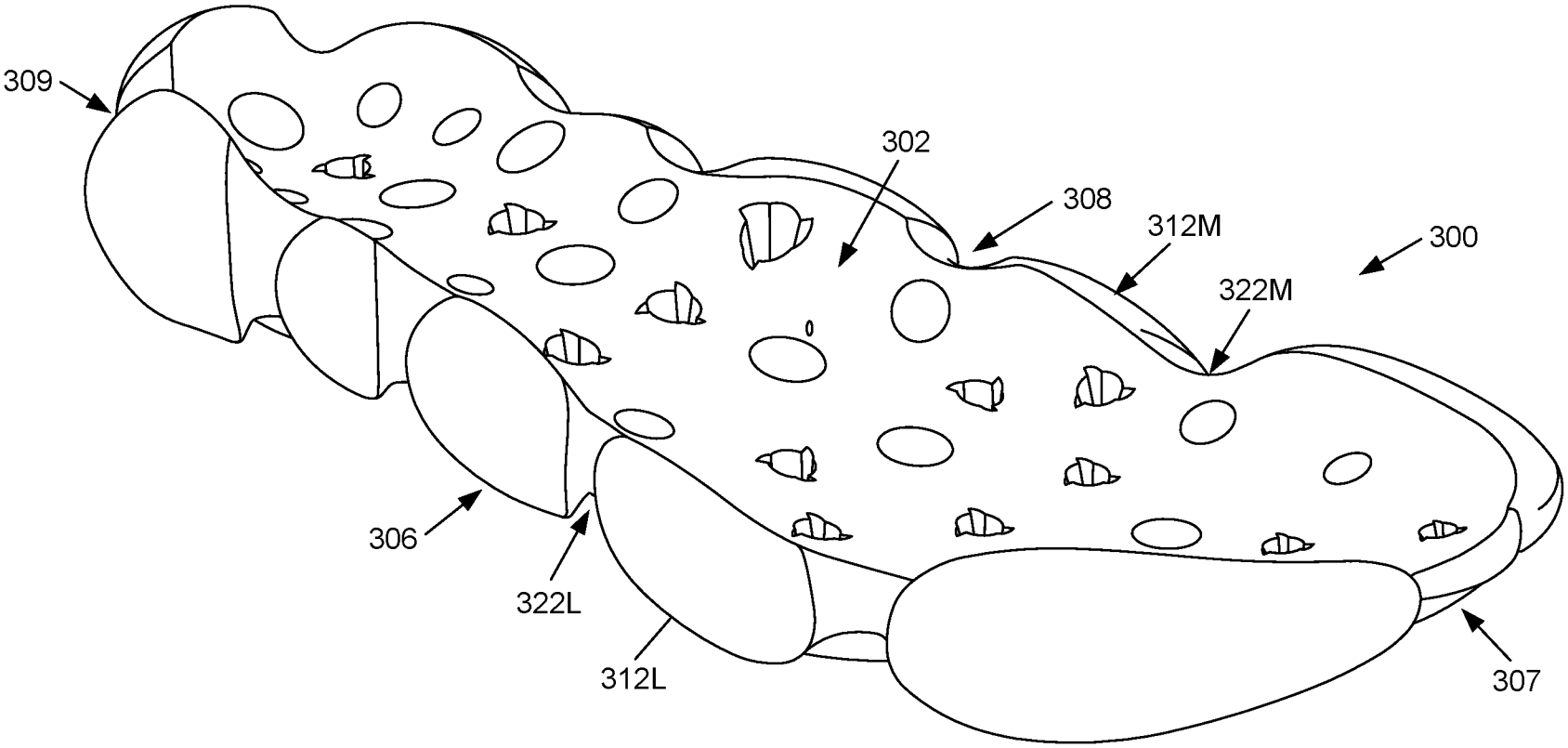
FIGS. 3A and 3B depict a lateral perspective view and a bottom-side view, respectively, of an example midsole component in accordance with aspects herein.
Figure 3B:
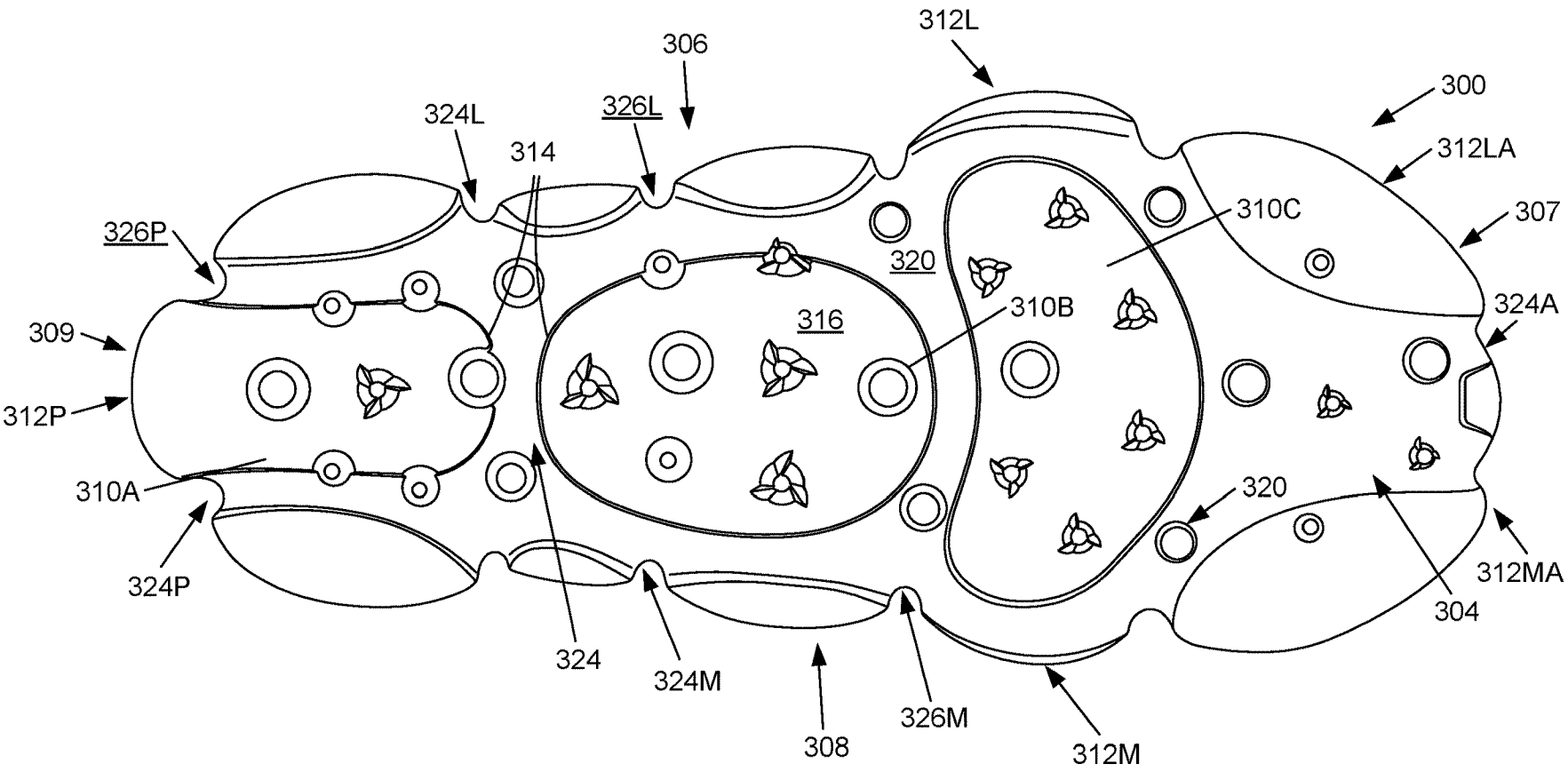

FIG. 3A depicts a top perspective view of the midsole component 300, and FIG. 3B depicts a bottom view of the midsole component 300. The midsole component 300 includes a top side 302, a bottom side 304, a lateral side 306, and a medial side 308. The top side 302 generally corresponds with a superior portion of the midsole component 300 that is oriented towards a person's foot when the footwear 100 is being worn. The bottom side 304 is opposite the top side 302 and generally corresponds with a bottom portion oriented away from the wearer's foot and towards the ground, floor, or other surface when the footwear 100 is being worn. The lateral side 306 extends between the top side 302 and the bottom side 304 on the lateral side 116 of the footwear 100, and the medial side 308, which is opposite the lateral side 306, extends between the top side 302 and the bottom side 304 on the medial side 118 of the footwear.

The bottom side 304 of the midsole component 300 includes a plurality of protrusions, including a first protrusion 310A, a second protrusion 310B, and a third protrusion 310C, which may be collectively referred to herein as the protrusions 310. The protrusions 310 extend outward from a recessed bottom surface 320 of the bottom side 304 and toward a ground, floor or other external surface when the footwear 100 is worn. Each protrusion 310 includes a protruding bottom surface 316 that forms the surface of the protrusion 310 that is farthest form the top side 302, and also includes side walls 314 that extend between the surface 316 and the recessed bottom surface 320. In some aspects, these side walls 314 may be continuous surfaces without ridges or recesses.

Recesses 324 (or grooves) are formed between side walls 314 of adjacent protrusions 310. The first protrusion 310A may generally be located within a heel region 106 of the footwear 100; the second protrusion 310B may generally be located within the midfoot region 104 of the footwear 100, and the third protrusion 310C may generally be located within the toe region 102 of the footwear 100.

The midsole component 300 may also include a protrusions along the lateral side 306, medial side 308, anterior side 307, and/or posterior side 309, where these protrusions extend outward from the midsole component 300 in a direction generally perpendicular to the direction in which the protrusions 310 on the bottom side 304 extend. For example, lateral-side protrusions 312L extend outward from recessed lateral surfaces 326L along the lateral side 306 of the midsole component 300. Lateral-side recesses 324L are created between adjacent lateral-side protrusions 312L. Medial-side protrusions 312M extend outward from recessed medial surfaces 326M along the medial side 308 of the midsole component 300, and medial-side recesses 324M are created between adjacent medial-side protrusions 312M. Further, a posterior-side protrusion 312P extends outward from recessed posterior surfaces 326P on the posterior side 309 and is positioned between two posterior-side recesses 324P. As shown in the example implementation shown in FIGS. 3A and 4B, a lateral anterior-side protrusion 312LA and a medial anterior-side protrusion 312MA may be adjacent anterior-side recesses 324A. The lateral anterior-side protrusion 312LA may be positioned to extend long both the lateral side 306 and the anterior side 307 of the midsole component 300, and the medial anterior-side protrusion 312MA may be positioned to extend long both the medial side 308 and the anterior side 307 of the midsole component 300.

The protrusions 312 may have distal surfaces (i.e., bottom surfaces 316) facing away from the midsole component 300 that have ribs or raised structures, which may provide traction and/or increased durability. An example of such raised structure is illustrated in FIG. 5A but removed from other views to not obstruct the view of other features. The distal surfaces of the protrusions 310 on the bottom side 304 of the midsole component 300 may have holes or cavities, which may aid in flexion and/or ground-force attenuation of the midsole component 300.

The locations of the protrusions 310, 312L, 312M, 312P, 312MA, and 312LA on the midsole component 300 may correspond to openings in the knitted upper component 200 and/or opening in the exterior sole component 400 that receive one or more of the protrusions.

Figure 4:
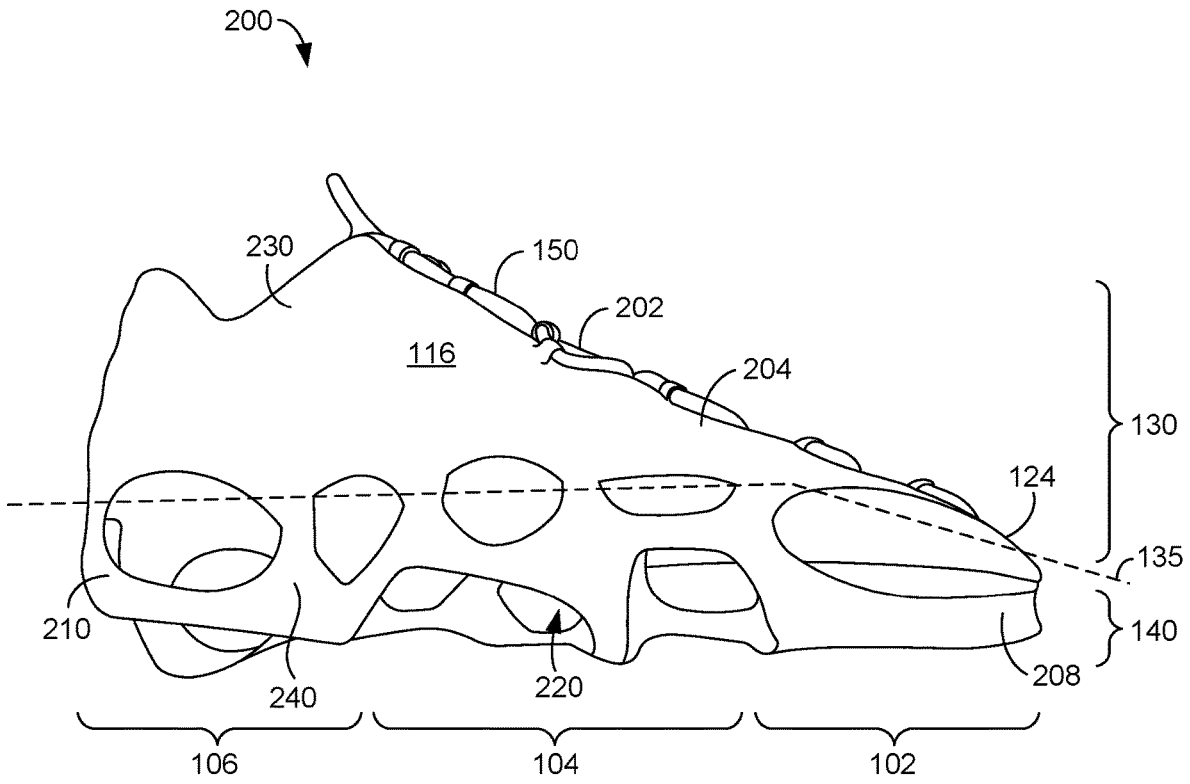
FIG. 4 depicts a side view of an example knitted upper component in accordance with aspects herein.

FIG. 4 depicts a lateral side view of the upper 110 with the knitted upper component 200 folded into the shape of an upper and fastened with a fastening system, such as the lace 150. The knitted upper component 200 forms an overfoot portion 130 and a lower portion 140 of the upper 110. The overfoot portion 130 forms a superior aspect of the upper 110 in that it extends over the top and at least partway down the lateral and medial sides of a wearer's foot when the footwear 100 is being worn. The overfoot portion 130 extends at least through the toe region 102 and the midfoot region 104. The lower portion 140 of the upper is configured to extend underneath a wearer's foot (either directly or separated by one or more sole components). The lower portion 140 extends through the toe region 102, the midfoot region 104, and the heel region 106. The transition between the overfoot portion 130 and the lower portion 140 is represented by the dashed line 135 in FIG. 4. Together, the overfoot portion 130 and the lower portion 140 define an interior chamber that may be accessed at least through the ankle opening 122.

The overfoot portion 130 of the upper 110 is formed by a main body portion 230 of the knitted upper component 200 that generally includes a continuous knit structure extending from within the toe region 102, through the midfoot region 104, and to the heel region 106. In contrast, a midsole containment portion 240 of the knitted upper component 200 includes a plurality of knit strips 210 that define openings 220 in the knitted upper component 200.

Figure 5B:
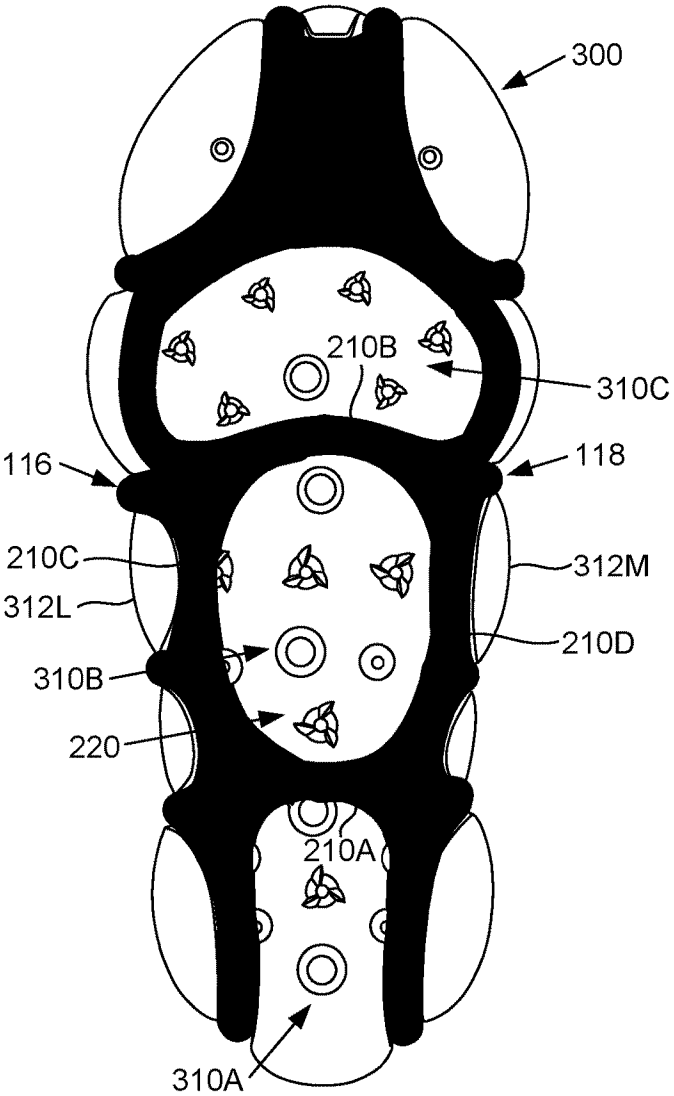
FIGS. 5A and 5B depicts views of the knitted upper component of FIG. 4 positioned around the midsole component of FIGS. 3A and 3B in accordance with aspects herein.
Figure 5A:
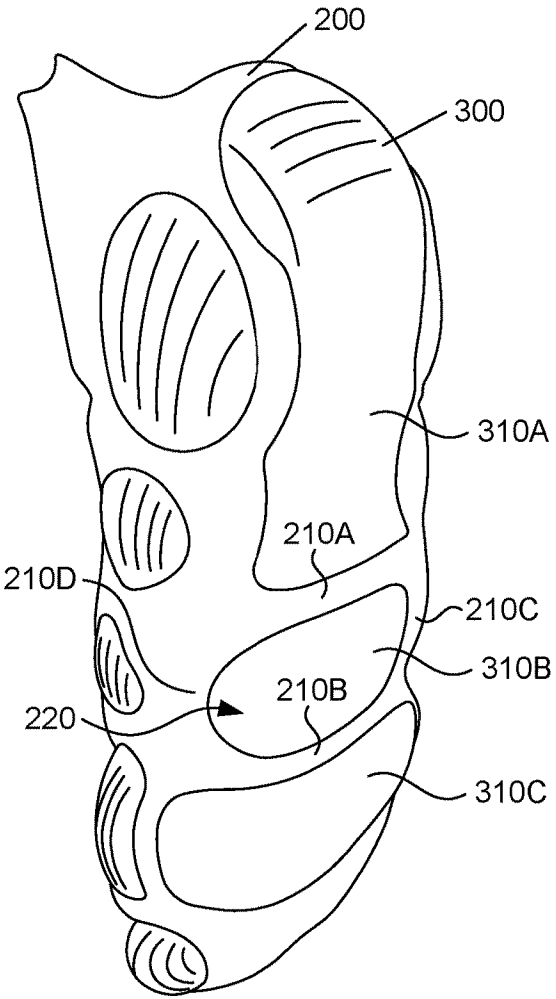

The midsole containment portion 240 is generally configured to engage with protrusions and recesses of the midsole component 300 to help keep the midsole component 300 contained when in the interior chamber defined by the knitted upper component 200 as shown in FIGS. 5A and 5B, which depict a bottom perspective view and a bottom view, respectively, of the knitted upper component 200 coupled to the midsole component 300. The knitted upper component 200 is depicted as solid black in FIG. 5A (as well as in FIG. 6 and FIG. 18B) only for purposes of distinguishing the knitted upper component from the midsole component 300 in those views.

The lower portion 140 of the knitted upper component 200 includes strips 210 that are integrally knitted together and define a plurality of openings 220 in the lower portion 140. Openings 220 at least partially defined by strips 210 that extend between the lower portion 140 and the overfoot portion 130 are located partially in the lower portion 140 and partially in the overfoot portion 130.

The knit strips 210 of the knitted upper component 200 include a first lower knit strip 210A and a second lower knit strip 210B each extending continuously from the lateral side 116 to the medial side 118 on the lower portion 140. Each of the first lower knit strip 210A and the second lower knit strip 210B are positioned within a recess 324 defined by adjacent protrusions of the midsole component 300. For example, the first lower knit strip 210A of the knitted upper component 200 is positioned within a recess between the first protrusion 310A and the second protrusion 310B on the bottom side 304 of the midsole component 300, while the second lower knit strip 210B of the knitted upper component 200 is positioned within a recess between the second protrusion 310B and the third protrusion 310C on the bottom side 304 of the midsole component 300.

The knit strips 210 also include strips extending in a longitudinal direction, such as a third lower knit strip 210C and a fourth lower knit strip 210D. The third lower knit strip 210C of the knitted upper component 200 is positioned between the second protrusion 310B on the bottom side 304 and one or more protrusions 312 on the lateral side 306 of the midsole component 300, while the fourth lower knit strip 210D is positioned between the second protrusion 310B and one or more protrusions on the medial side 308 of the midsole component 300. Each of the third and fourth lower knit strips 210C and 210D continuously extend between the first and second lower knit strips 210A and 210B, and lower knit strips 210A-D collectively define an opening 220 through which a protrusion of the midsole component 300 (the second protrusion 310B) extends.

Similarly, knit strips 210 extending up the sides of the knitted upper component 200 may be positioned within recesses 324L, 324M, 324P, 324A between protrusions 312L, 312M, 312P, 312LA, and 312MA. There may be some frictional engagement between the knit strips 210 of the knitted upper component 200 and the protrusions 310, 312L, 312M, 312P, 312LA, and 312M that help keep the knit strips 210 in place around the midsole component 300. In some aspects, there may be an additional mechanism to keep the knit strips 210 in place around the midsole component. For example, there may be removable securement devices that secure at least some of the knit strips 210 to the midsole component 300 as shown in FIG. 6.

Figure 6:
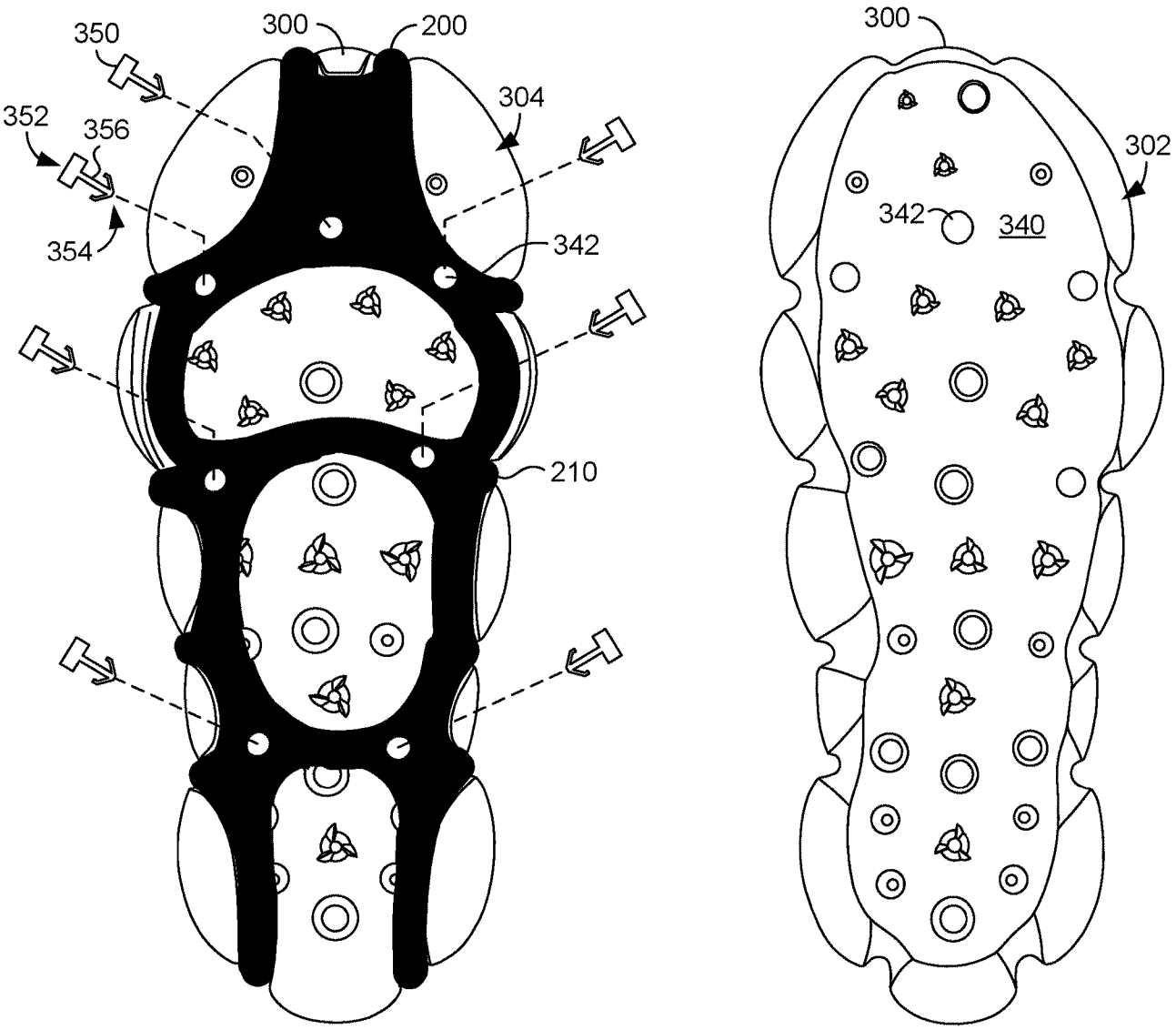
FIG. 6 depicts example removable securement devices for additional coupling of the knitted upper component of FIG. 4 and the midsole component of FIGS. 3A and 3B in accordance with aspects herein.

FIG. 6 depicts an example aspect in which removable securement devices 350 help secure the knit strips 210 around the midsole component 300. FIG. 6 shows the bottom side 304 and the top side 302 of the midsole component. While the view of the bottom side 304 includes the knitted upper component 200, the knitted upper component 200 has been removed from the top side 302 view so as to not obstruct the top side 302. The midsole component 300 includes securement openings 342 extending from the top side 302 to the bottom side 304 of the midsole component 300. These openings 342 extend from a top-side surface 340 on the top side 302 to the recessed bottom surface 320 on the bottom side 304 (which is visible in FIG. 3B). Each removable securement device 350 extends through a knit strip 210 that lays adjacent the recessed bottom surface 320, through a securement opening 342. After extending at least partially through a securement opening 342, the securement devices mechanically engages with the midsole component 300 in the inside of the opening 342 or on the top-side surface 340, to keep the securement device 350 in place.

In this example, the removable securement devices 350 may be referred to as pins or snaps. Each removable securement device 350 includes a first end 354, a second end 352, and a middle section 356 between the first end 354 and the second end 352. The first end 354 may include flanges made of a pliable material. When the first end 354 extends through the securement opening 342, the flanges may flex inward toward the middle section 356 so that the width or diameter of first end 354 is at least partially reduced so that it is less than the width or diameter of the securement opening 342. In some aspects, the first end 354 extends completely through the securement opening 342 so that the flanges on the first end 354 may return to their extended positon and lock to the top-side surface 340 around the securement opening 342. In other aspects, the first end 354 does not exit the securement opening 342 on the top side 302 but, rather, engages with a structure within the securement opening 342 so that the removable securement device 350 does not fall out of the securement opening 342 on the bottom side 304. The middle section 356 of the removable securement device 350 may be configured to extend through and be positioned within the securement opening 342 when the first end 354 is engaged. The second end 352 of the removable securement device 350 may be wider than the middle section 356. In some aspects, the securement opening 342 is tapered or otherwise has a varied width, and the second end 352 extends partway through the opening 342 but is unable to extend further when the width of the securement opening 342 narrows, which may help prevent the removable securement device 350 from falling out through the securement opening 342 on the top side 302.

The removable securement devices 350 may be removable in that a user may be able to remove them upon applying sufficient force, such as by pulling on the second ends 352. In this way, the removable securement devices 350 may help keep the knitted upper component 200 secured around the midsole component 300 without the use of adhesives, stitching or other mechanisms that would impede the ability to easily deconstruct the footwear 100. In exemplary aspects, the removable securement devices 350 are made from recyclable material.

Figure 7A:
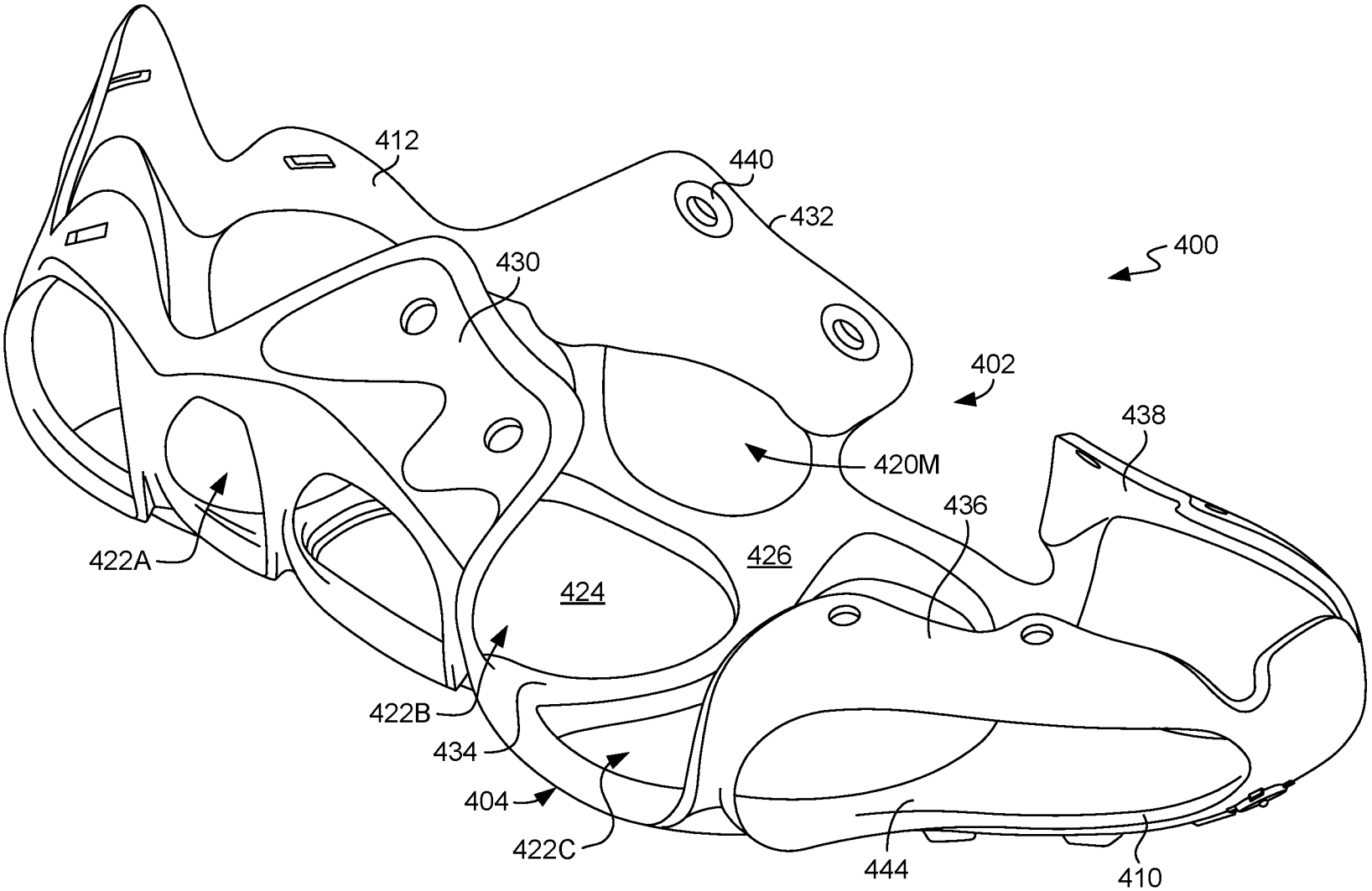
FIGS. 7A-7C depict views of an example exterior sole component in accordance with aspects herein.
Figure 7B:
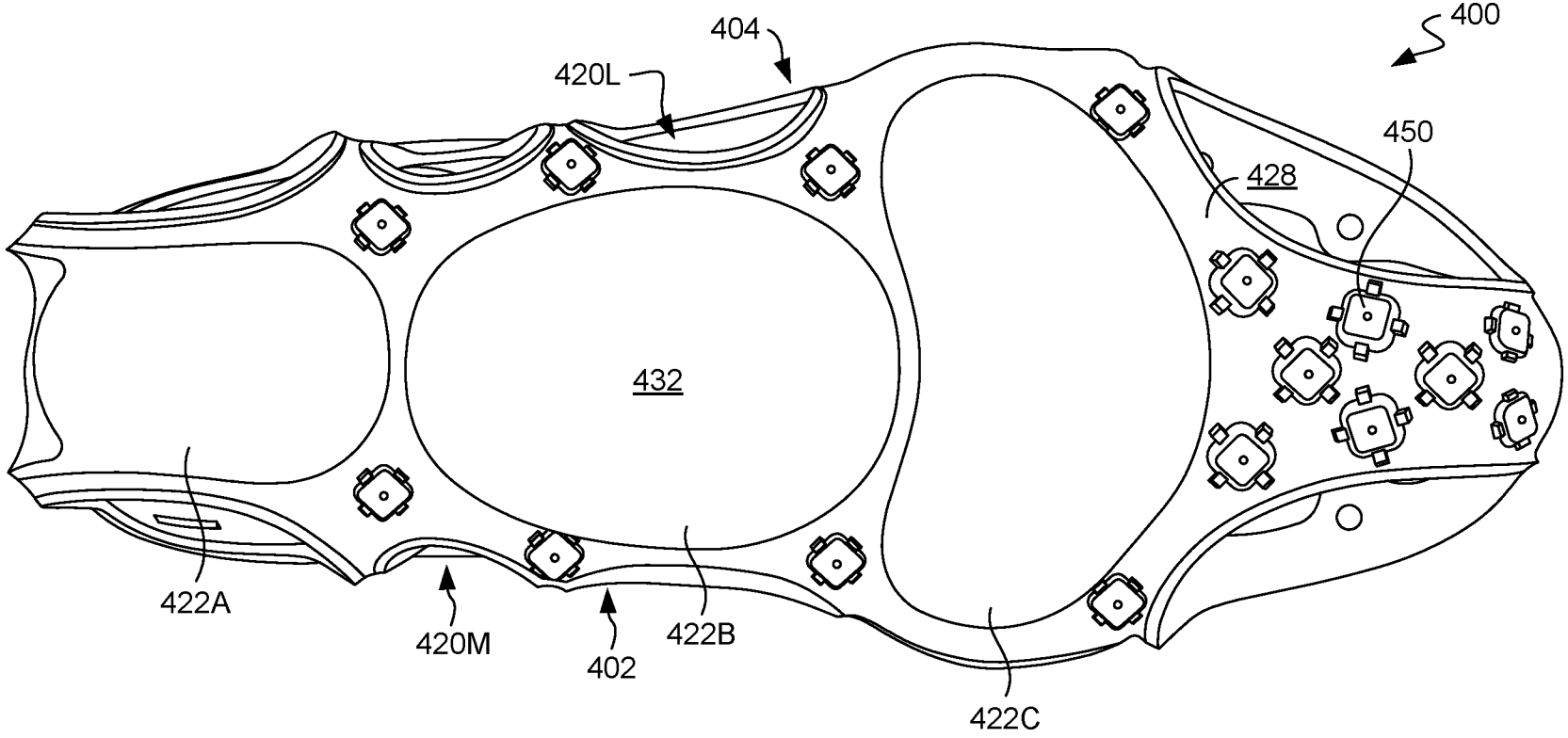

FIGS. 7A and 7B depict a lateral side perspective view and a bottom side view of the exterior sole component 400. The exterior sole component 400 includes a medial side 402 and a lateral side 404. The exterior sole component 400 further includes an underfoot portion 410 and an upper portion 412. The underfoot portion 410 is configured to extend underfoot when the footwear 100 is worn, such that the underfoot portion 410 may form a ground-contacting surface for the footwear 100. The upper portion 412 is configured to extend along and over portions of the knitted upper component 200 when the footwear 100 is assembled.

The exterior sole component 400 includes openings on at least the medial side 402 and the lateral side 404 configured to receive protrusions of the midsole component 300. For example, lateral-side openings 420L on the exterior sole component 400 are configured to receive lateral-side protrusions 312L on the midsole component 300, and medial side openings 420M are configured to receive medial-side protrusions 312M when the midsole component 300 is received within the exterior sole component 400.

The underfoot portion 410 of the exterior sole component 400 may include recesses for receiving protrusions of the midsole component 300. Particularly, the recesses 422A, 422B, and 422C (which may be collectively referred to as recesses 422) of the exterior sole component 400 may receive the protrusions 310A, 310B, and 310C, respectively, on the bottom side 304 of the midsole component 300. The recesses 422 each include a recessed surface 424 that is positioned below the top-side surface 426 of the underfoot portion 410 that extends between recesses 422. When the footwear 100 is assembled, the recessed surface 424 of the exterior sole component 400 is positioned adjacent to and contacts the bottom protruding surface 316 on the bottom side 304 of the midsole component 300. The top-side surface 426 of the underfoot portion 410 of the exterior sole component 400 may be positioned to be adjacent to and contact at least a portion of the knit strips 210 of the knitted upper component 200 when the footwear 100 is assembled.

In the example exterior sole component 400 depicted in FIGS. 7A and 7B, the recesses 422 in the underfoot portion 410 receive protrusions 310 of the midsole component 300 while preventing the protrusions 310 from extending all the way through the underfoot portion 410 of the exterior sole component 400. In this way, the exterior sole component 400 may provide the ground contacting surface when the footwear 100 is assembled. For example, protruding bottom surface 432 of the exterior sole component 400 that forms the surface opposite the recessed surface 424 may form the ground contacting surface. It is contemplated that, in other aspects, recesses 422 on the underfoot portion 410 of the exterior sole component 400 may be openings (similar to openings 220 of the knitted upper component 200) such that the protrusions 310 of the midsole component 300 may extend completely through the underfoot portion 410 of the exterior sole component 400 to form ground-contacting surfaces.

Figure 7C:
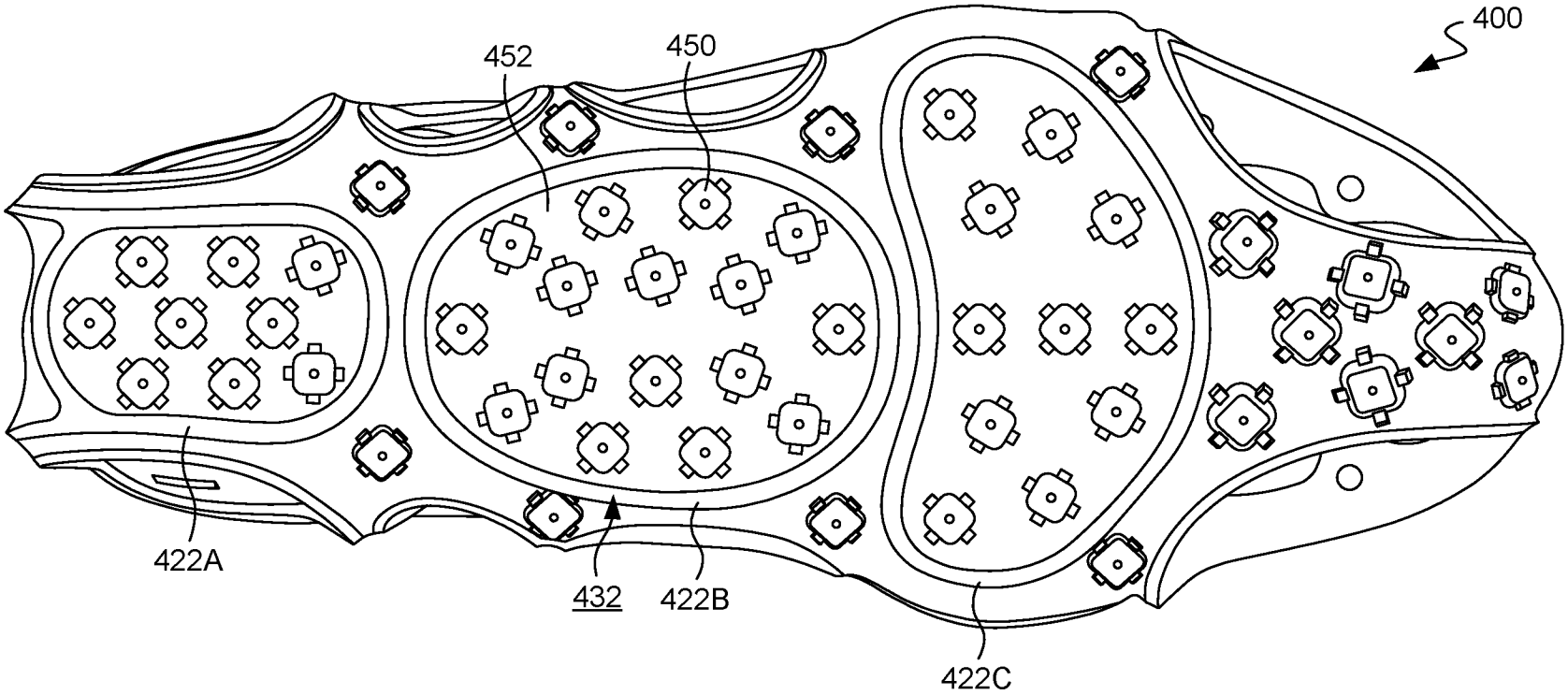

The protruding bottom surface 432 of the recesses 422 on the opposite side of the underfoot portion 410 may include traction elements 450. FIG. 7C depicts a bottom side view of an aspect of the exterior sole component 400 in which traction elements 450 are applied to the protruding bottom surface 432. Particularly, traction components 452 each having a plurality of traction elements 450 (such as protrusions or cleats) may be applied to the protruding bottom surface 432 of the recesses 422A, 422B, and 422C (which may form protrusions when viewed from the bottom side of the exterior sole component 400). These traction components 452 may have substantially the same size and shape as the protruding bottom surfaces 432 of these recesses 422A, 422B, and 422C. Further, traction components 452 may be made from a thermoplastic polymer material like the rest of the exterior sole component 400. For example, the traction components 452 and the exterior sole component 400 may be made from a thermoplastic polyurethane material. The traction components 452 and the exterior sole component 400 may be co-molded together such that they may effectively form a unitary structure. In this way, the traction components 452 may be recycled along with the exterior sole component 400

Figure 8:
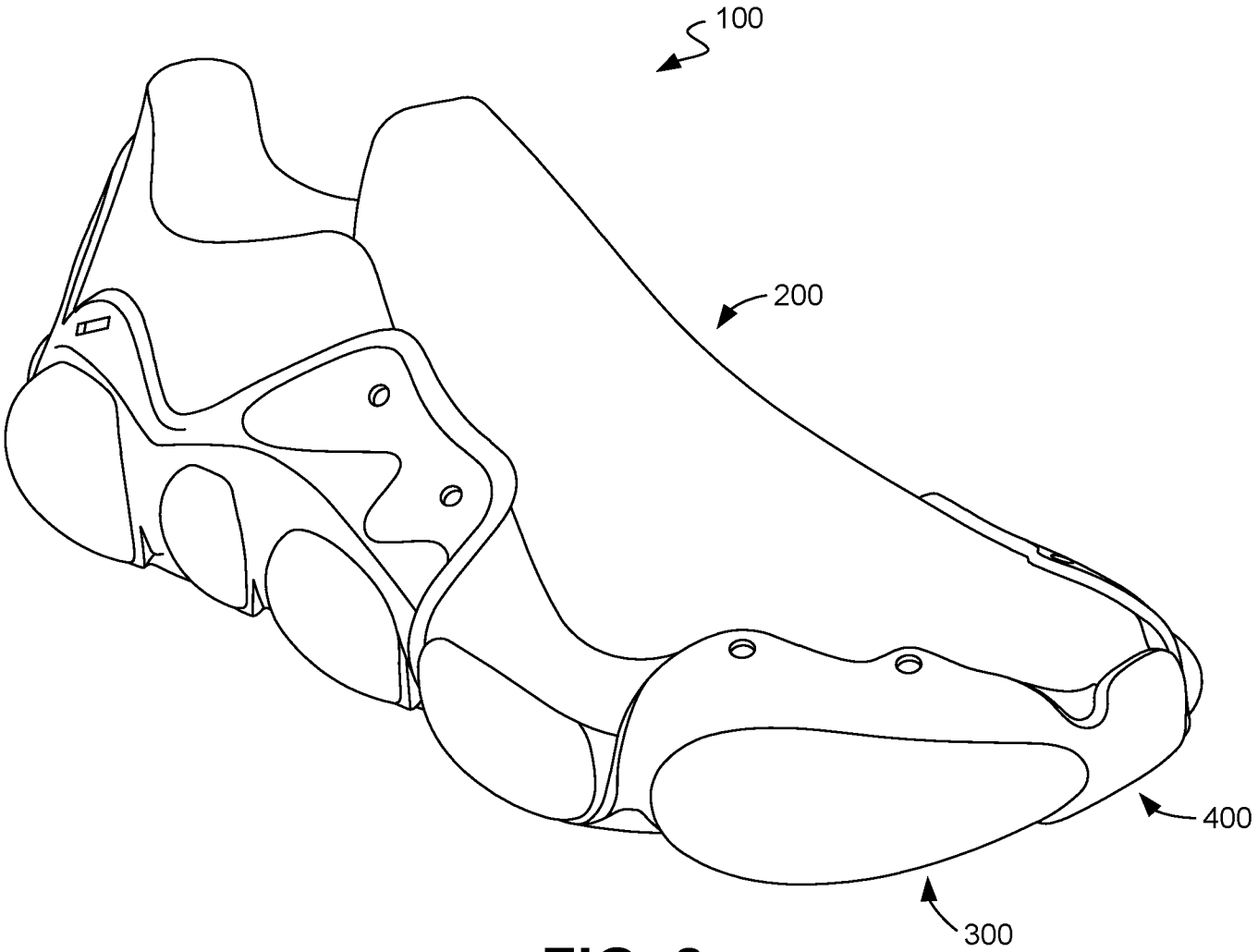
FIG. 8 depicts the knitted upper component, the midsole component, and the exterior sole component coupled together in accordance with aspects herein.

FIG. 8 depicts the exterior sole component 400 wrapped around the midsole component 300 and the knitted upper component 200. While some details of the knitted upper component 200 may been removed in FIG. 8 for clarity, it should be understood that the knitted upper component 200 in FIG. 8 should be the same or similar to the knitted upper component of FIGS. 1A-1B, 2, and 4.

Figure 9:
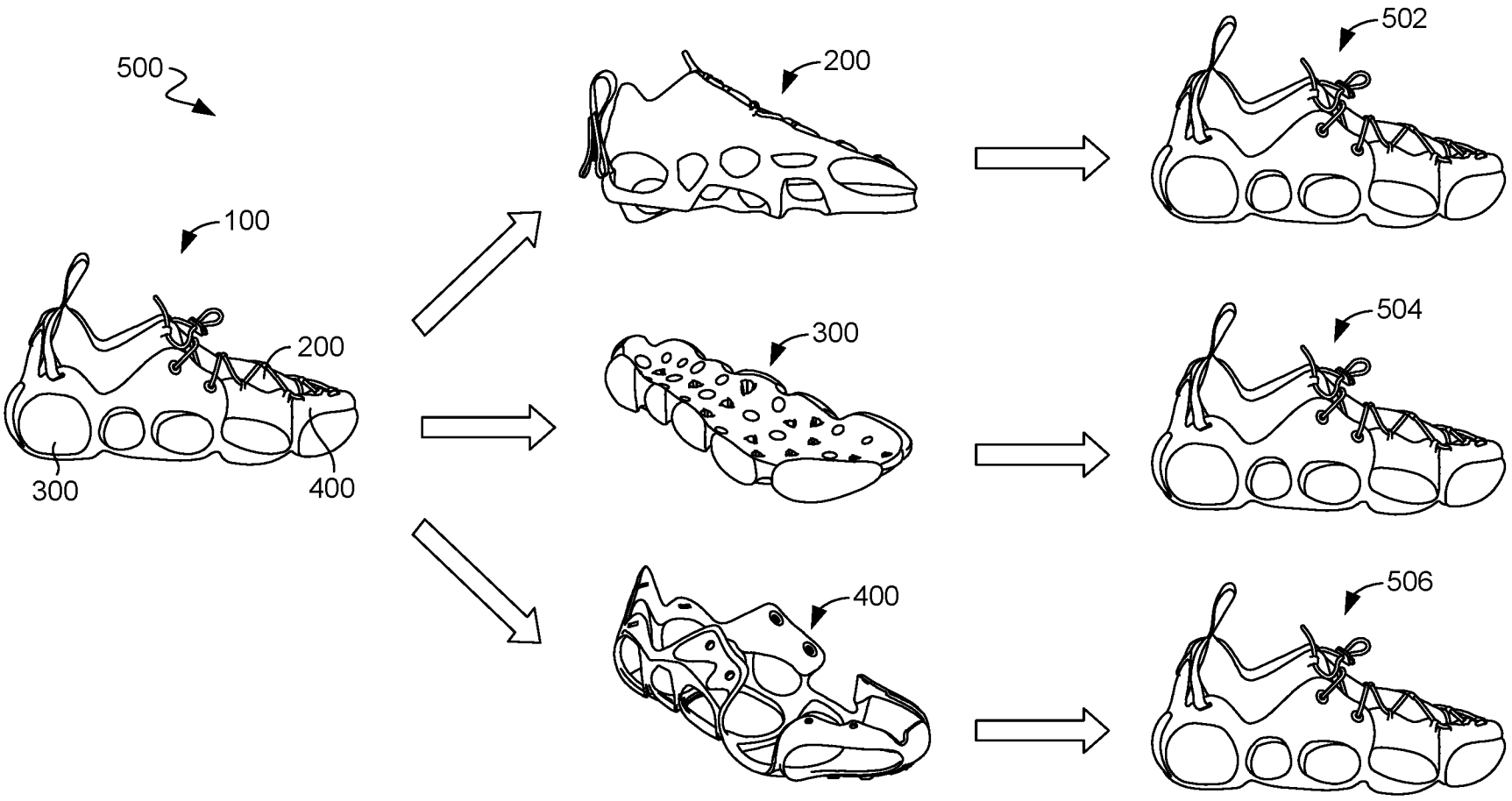
FIG. 9 depicts a schematic diagram representing an example system for sustainable footwear articles in accordance with aspects herein.

FIG. 9 provides a schematic representation of a sustainable system 500 for articles of footwear in accordance with aspects of the disclosure. The article of footwear 100 of FIGS. 1A-8 may be constructed so that the components 200, 300, and 400, may be separated without substantial burden such that a user may separate the components 200, 300, or 400 without ripping, tearing or otherwise destroying the integrity of the individual components 200, 300, and 400. In this way, the footwear 100 may be easily deconstructed from recycling the raw materials of the individual components 200, 300, or 400 or for re-using components in another article of footwear with different combinations of components.

As shown in FIG. 9, footwear 100 may be deconstructed so that the exterior sole component 400 is removed from around the midsole component 300 and the knitted upper component 200, and the midsole component 300 is removed from the interior chamber of the knitted upper component 200. One or more of these components may be recycled for the creation of additional articles of footwear 502, 504, and 506.

In some aspects, the materials from the components 200, 300, and 400 are recyclable materials such that they may be used to form new components for footwear articles 502, 504, and 506. For example, the footwear 502 may have a knitted upper component with yarns derived from the knitted upper component 200 where the knitted upper component 200 no longer exists in its original form. The footwear 504 may have a midsole component comprising a thermoplastic polymer material component recycled from the midsole component 300 of footwear 100 where the midsole component 300 no longer exists in its original form. The footwear 506 may have an exterior sole component comprising a thermoplastic polymer material component recycled the exterior sole component 400 where the exterior sole component 400 no longer exists in its original form. Further, it should be understood that any of footwear articles 502, 504, and 506 may have multiple components made from recycled materials from a no-longer existing footwear. For example, footwear 502 may have a knitted upper component with yarns derived from a no-longer existing knitted upper, a midsole component comprising a thermoplastic polymer material component recycled a no-longer existing midsole component, and an exterior sole component comprising a thermoplastic polymer material component recycled a no-longer existing exterior sole component.

In other aspects, any of the components 200, 300, and 400 may be recycled in their entirety into a new footwear, rather than their materials being recycled to form new components. For example, new footwear 502 may include the knitted upper component 200. New footwear 504 may include the midsole component 300. New footwear 506 may include the exterior sole component 400. In this way, components that are being worn down may be replaced while other component(s) may still be used. This provides a more sustainable option than replacing an entire footwear when one of the components 200, 300, or 400 is worn or broken. Additionally, it allows for greater options for a wearer's footwear. For example, a wearer may own multiple knitted upper components of different colors or styles that each fit with the midsole component 300 and the exterior sole component 400 and may switch out the knitted upper components for different uses of the footwear 100. Different midsole components and/or different exterior sole components may be similarly swapped out for different uses. Further, customized footwear may be easier in different colors and/or styles of the individual components may be manufactured ahead of time, and a user may select the desired colors and/or styles for each of the knitted upper component 200, midsole component 300, and exterior sole component 400. The user may even be able to assemble the footwear 100 from the selected components.

As previously described, in some aspects of system 500, the knitted upper component 200, the midsole component 300, and the exterior sole component 400 may each be recycled and incorporated into separate articles of footwear 502, 504, and 506. But it is contemplated that multiple components from footwear in the system 500 may be recycled into the same new footwear. For example, the knitted upper component 200 and the midsole component 300 from footwear 100 may be used in a new footwear having a new exterior sole component. The knitted upper component 200 and the exterior sole component 400 from footwear 100 may be used together in a new footwear having a new midsole component. Similarly, the midsole component 300 and the exterior sole component 400 from footwear 100 may be used together in a new footwear having a new knitted upper component.

Figure 10:
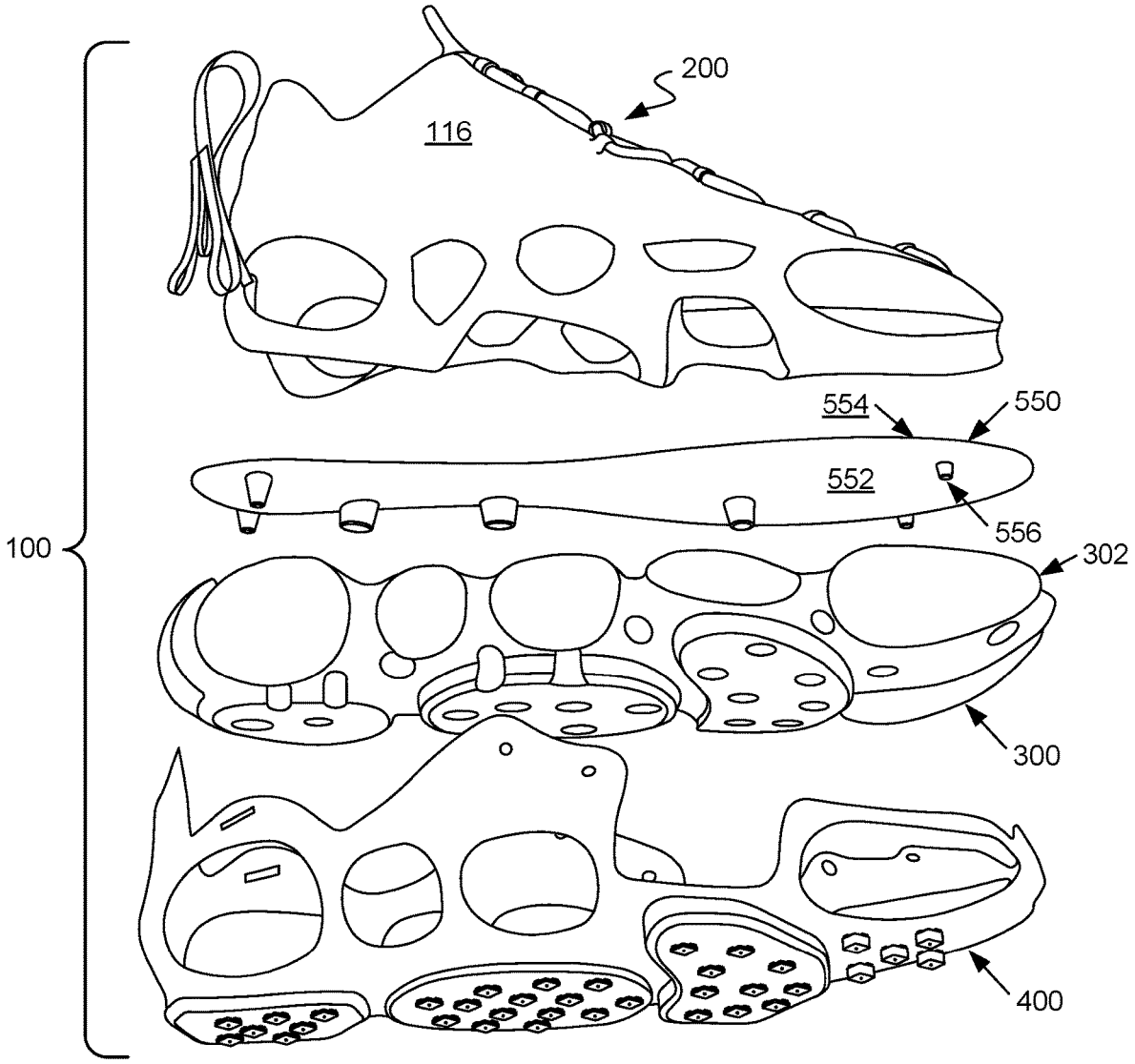
FIG. 10 depicts an exploded view of the article of footwear of FIGS. 1A and 1B with an example insole component in accordance with aspects herein.

FIG. 10 depicts an exploded view of another embodiment of footwear 100. Footwear 100 may have the same features as previously described with respect to FIGS. 1A-9, but may include an insole component 550 that is configured to be positioned on top of the midsole component 300 inside the interior chamber of the knitted upper component 200. The insole component 550 includes a top surface 554 generally configured to face the wearer's foot when the footwear 100 is worn, and a bottom surface 552 opposite the top surface and generally configured to face toward the midsole component 300. The insole component 550 may have insole engagement protrusions 556 extending downward from the bottom surface 552 of the insole component 550 and engage with openings on the top side 302 of the midsole component 300. In exemplary aspects, no adhesives or stitching is used to couple the midsole component 300 and the insole component 550. The insole component 550 may provide a smoother and more comfortable surface for a wearer to place his or her foot when the footwear 100 is worn. The insole component 550 may be constructed from recyclable material, such as a thermoplastic polyurethane or other recyclable thermoplastic polymer material. The insole component 550 may also be easily removed from the midsole component 300 through the use of some force.

Figure 11:
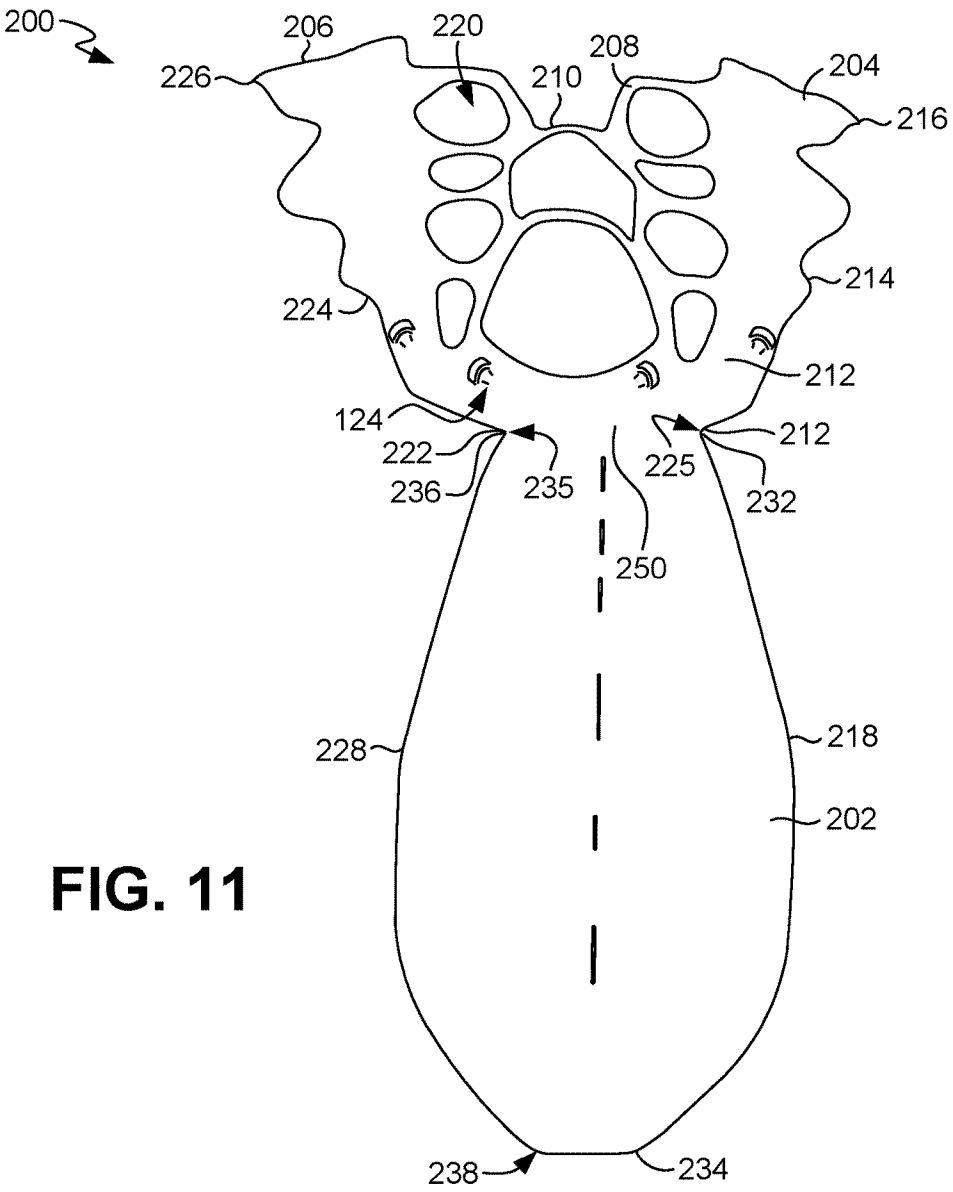
FIG. 11 depicts the knitted upper component of FIG. 4 in an unfolded configuration in accordance with aspects herein.
Figure 12:
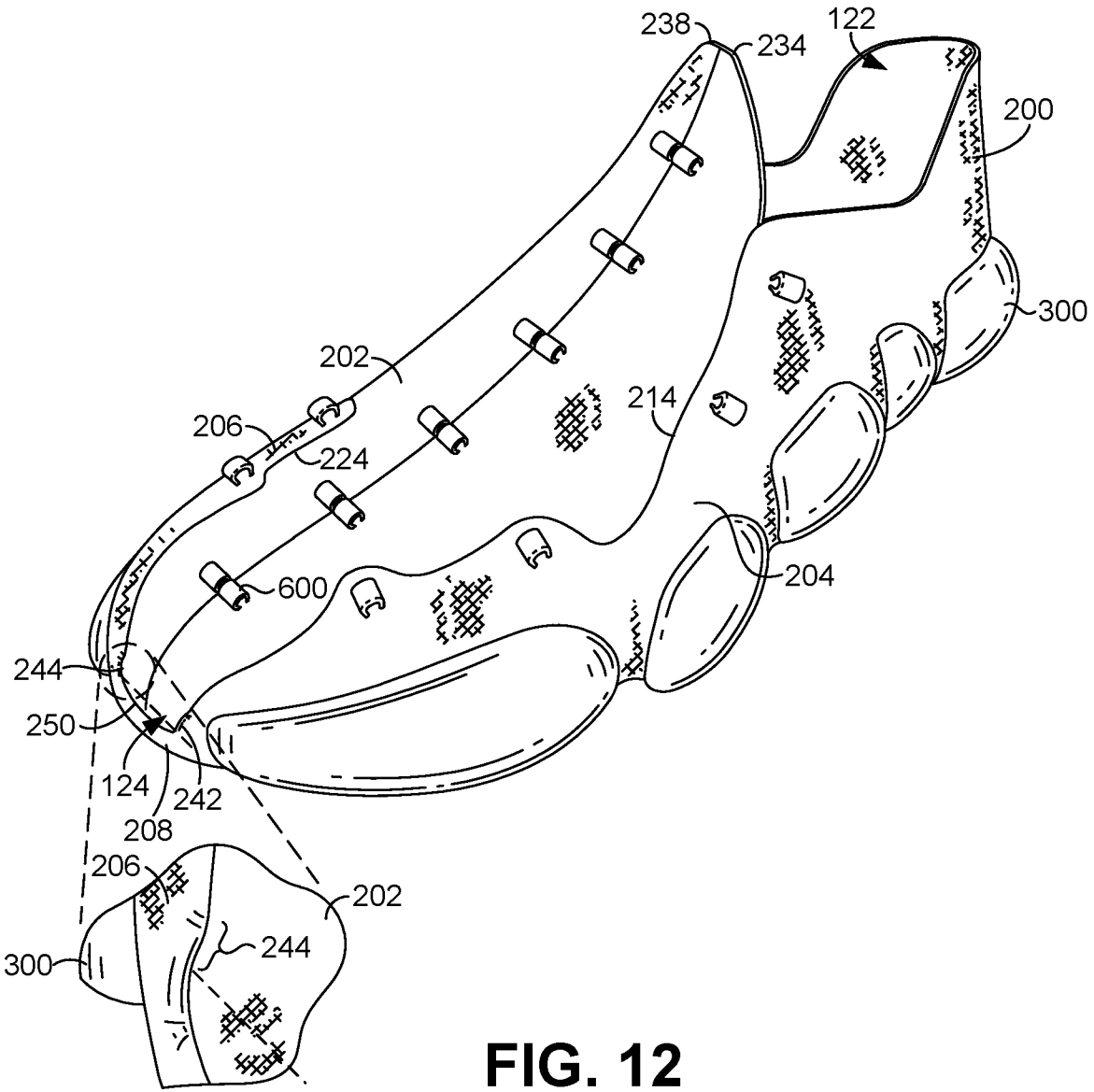
FIG. 12 depicts a lateral side perspective view of the knitted upper component of FIG. 11 folded and coupled to a midsole component in accordance with aspects herein.

FIG. 11 depicts a planar view of the knitted upper component 200 in an unfolded configuration, and FIG. 12 depicts a lateral side perspective view when the knitted upper component 200 is folded and contains the midsole component 300. As previously discussed, the knitted upper component 200 may be formed from recyclable materials, such as polyester yarn. Further, in some aspects, yarn forming the knitted upper component 200 may be recycled from a no-longer existing item, such as a no-longer existing knitted upper component. As such, the yarns forming the knitted upper component 200 may be recycled and further recyclable.

The constructions of the knitted upper component 200 may further aid in the use of the knitted upper component 200 in a modular footwear system as described above with respect to FIGS. 1A-10 that enable easy recycling and/or customization of the footwear 100. For example, the knitted upper component 200 may be knitted in a shape that allows for creation of a large opening through the ankle opening 122 so that the midsole component 300 may be inserted into and removed from the interior chamber of the knitted upper component 200.

The knitted upper component 200 includes an overfoot knit panel 202, a lateral knit panel 204, a medial knit panel 206, and a lower knit panel 208. The overfoot knit panel 202, the lateral knit panel 204, and the medial knit panel 206 may generally form the main body portion 230 of the knitted upper component 200, while the lower knit panel 208 may generally form the midsole containment portion 240. Although referred to as panels, it should be understood that these components of the knitted upper component 200 may have a unitary knit construction such that they are integrally formed as a single textile piece on a knitting machine. As such, panels 202, 204, 206, and 208 may be seamlessly connected to one another through knitted stitches in one or more regions. In other aspects, one or more of these panels may be knit separately and stitched together. Even where knit panels are stitched together, the article of footwear 100 may otherwise not include stitching between the knitted upper component 200 and the midsole component 300 or the exterior sole component 400.

The lateral knit panel 204 may form a lateral aspect of the overfoot portion 130 of the upper 110. Particularly, the lateral knit panel 204 extends along the lateral side 116, from within the anterior portion 124 of the toe region 102 at least towards the heel region 106. The lateral knit panel 204 includes a lateral-panel top edge 214 having a first end 212 and a second end 216 opposite the first end 212. The first end 212 of the lateral-panel top edge 214 terminates in the anterior portion 124 of the toe region 102.

Similarly, the medial knit panel 206 may form a medial aspect of the overfoot portion 130 of the upper 110. Particularly, the medial knit panel 206 extends along the medial side 118, from within the anterior portion 124 of the toe region 102 at least towards the heel region 106. In some aspects, the medial knit panel 206 is shaped as a mirror image of the lateral knit panel 204. The medial knit panel 206 also includes a medial-panel top edge 224 having a first end 222 and a second end 226 opposite the first end 222. The first end 222 of the medial-panel top edge 224 terminates in the anterior portion 124 of the toe region 102.

In example aspects, the lateral knit panel 204 and the medial knit panel 206 each extend through the heel region 106 such that the lateral knit panel 204 and medial knit panel 206 each extend all or substantially all the entire length of the upper 110. As such, the second ends of the lateral-panel top edge 214 and the medial-panel top edge 224 may each terminate in the heel region 106. In some aspects, the lateral knit panel 204 and the medial knit panel 206 are secured together to form a seam in the heel region 106 such that second ends 216 and 226 of the lateral-panel top edge 214 and the medial-panel top edge 224 terminate in the heel region 106.

At least part of the overfoot knit panel 202 is positioned between the lateral knit panel 204 and the medial knit panel 206 such that the overfoot knit panel 202 may be configured to form a central or superior aspect of the overfoot portion 130 of the upper 110. When the knitted upper component 200 is folded into the shape of the upper 110, the overfoot knit panel 202 extends from within the anterior portion 124 of the toe region 102 to the ankle opening 122. In some aspects, the overfoot knit panel 202 extends the entire lengths of the toe region 102 and midfoot region 104 of the upper 110. The overfoot knit panel 202 is extends in a continuous and seamless manner between the medial side 118 and the lateral side 116 of the upper 110. As such, the line extending down the center of the overfoot knit panel 202 in the views depicted in some of the figures should not be construed as a seam.

The overfoot knit panel 202 includes an overfoot-panel lateral edge 218 and an overfoot-panel medial edge 228. The overfoot-panel lateral edge 218 includes a first end 232 and a second end 234 opposite the first end 232, while the overfoot-panel medial edge 228 includes a first end 236 and a second end 238 opposite the first end 236. The first ends 232 and 236 of the overfoot-panel lateral edge 218 and the overfoot-panel medial edge 228 terminates in the anterior portion 124 of the toe region 102, and the second ends 234 and 238 of the overfoot-panel lateral edge 218 and the overfoot-panel medial edge 228 terminates at the ankle opening 122. The term "edge" as used herein with respect to a panel of the knitted upper component 200 refers to an outer perimeter edge of the knitted upper component 200 such that an edge of a panel is a free edge and not an integrally knit transition between two portion of the knitted upper component 200.

Further, the overfoot-panel lateral edge 218 intersects the lateral-panel top edge 214 at a first edge intersection 225, and the overfoot-panel medial edge 228 intersects the lateral-panel top edge 224 at a second edge intersection 235. The first edge intersection 225 and the second edge intersection 235 may be located in the anterior portion 124 of the toe region 102. Immediately adjacent the first edge intersection 225 and the second edge intersection 235 is a joined area 250 where the overfoot knit panel 202, lateral knit panel 204, and medial knit panel 206 are integrally knitted to one another in the anterior portion 124 of the toe region 102. The joined area 250 is the only knitted connection between the overfoot knit panel 202 and either of the lateral knit panel 204 and the medial knit panel 206. Further, the joined area 250 may be the only direct securement of the overfoot knit panel 202 and either of the lateral knit panel 204 and the medial knit panel 206. In other words, in some aspects, the overfoot knit panel 202 is directly coupled to the lateral knit panel 204 and the medial knit panel 206 only through knitting in the joined area 250 and is not otherwise directly coupled to the lateral knit panel 204 or the medial knit panel 206 through stitching or bonding. In this way, a wearer may manipulate the overfoot knit panel 202 to move it independently over the lateral knit panel 204 and the medial knit panel 206 outside of the joined area 250.

The joined area 250 is in the anterior portion 124 of the toe region 102. In example aspects, the anterior portion 124 is the anterior-most quarter of the toe region 102 such that, if the toe region 102 were divided into four sections by evenly spaced apart cuts each extending from the lateral side 116 to the medial side 118, the anterior portion 124 of the toe region 102 may be considered to refer to the quarter-section immediately adjacent the transition between the overfoot portion 130 and the lower portion 140. In this way, the overfoot knit panel 202 may be at least not directly secured to the lateral knit panel 204 and the medial knit panel 206 through most of (such as approximately three-quarters of) the length of the toe region 102. Consequently, the overfoot knit panel 202 may be lifted and separated from the lateral knit panel 204 and the medial knit panel 206 through most of the toe region 102 to create an opening for inserting and/or removing the midsole component 300 from the interior of the knitted upper component 200 once the knitted upper component 200 is folded into the shape of the upper 110. In some aspects, the anterior portion 124 of the toe region 102 where the first edge intersection 225 and the second edge intersection 235 are located is at least partially covered by a sole structure, such as the exterior sole component 400, when the footwear 100 is assembled.

When the knitted upper component 200 is folded into the shape of the upper 110, the lateral knit panel 204 and the medial knit panel 206 may each partially overlap the overfoot knit panel 202. As such, at least part of the overfoot-panel lateral edge 218 may be positioned underneath the lateral knit panel 204, and at least part of the overfoot-panel medial edge 228 may be positioned underneath the medial knit panel 206 when the knitted upper component 220 is folded into the shape of the upper 110.

As illustrated in FIG. 12, integrally knit pleats are formed where the lateral knit panel 204 and the medial knit panel 206 are folded to partially overlap with the overfoot knit panel 202. An integrally knit lateral pleat 242 is formed near the first edge intersection 225 of the overfoot knit panel 202 and the lateral knit panel 204, and an integrally knit medial pleat 244 is formed near the second edge intersection 235 between the overfoot knit panel 202 and the medial knit panel 206. The lateral pleat 242 is a fold of the lateral knit panel 204 that partially overlaps the overfoot knit panel 202 and is formed where the lateral knit panel 204 is integrally knit to the overfoot knit panel 202. The medial pleat 244 is a fold of the medial knit panel 206 that partially overlaps the overfoot knit panel 202 and is formed where the medial knit panel 206 is integrally knit to the overfoot knit panel 202. In this way, the lateral pleat 242 and the medial pleat 244 may also be referred to herein as a lateral fold and a medial fold, respectively. FIG. 12 provides a close-up view of the medial pleat 244.

The lateral pleat 242 and the medial pleat 244 are positioned entirely within the toe region, and they may each have a first end terminating in the anterior portion 124 of the toe region 102. The first ends of the lateral fold 242 and medial fold 244 may be at or immediately adjacent to a boundary between the lower knit panel 208 and the overfoot knit panel 202. In some aspects, the entire lengths of the lateral pleat 242 and the medial pleat 244 are located within the anterior portion 124 of the toe region 102.

The lateral pleat 242 and the medial pleat 244 are integrally knit raised structures such that they extend above the rest of the knitted upper component 200 when the knitted upper component 200 is formed into the shape of the upper 110. In exemplary aspects, the lateral pleat 242 and the medial pleat 244 are the only pleats within the anterior portion 124 of the toe region 102 and in some aspects, the only pleats within the entire toe region 102. In some aspects, other types of raised structures, such as lace tunnels 600, may be located within the anterior portion 124 of the toe region 102.

Figure 13:
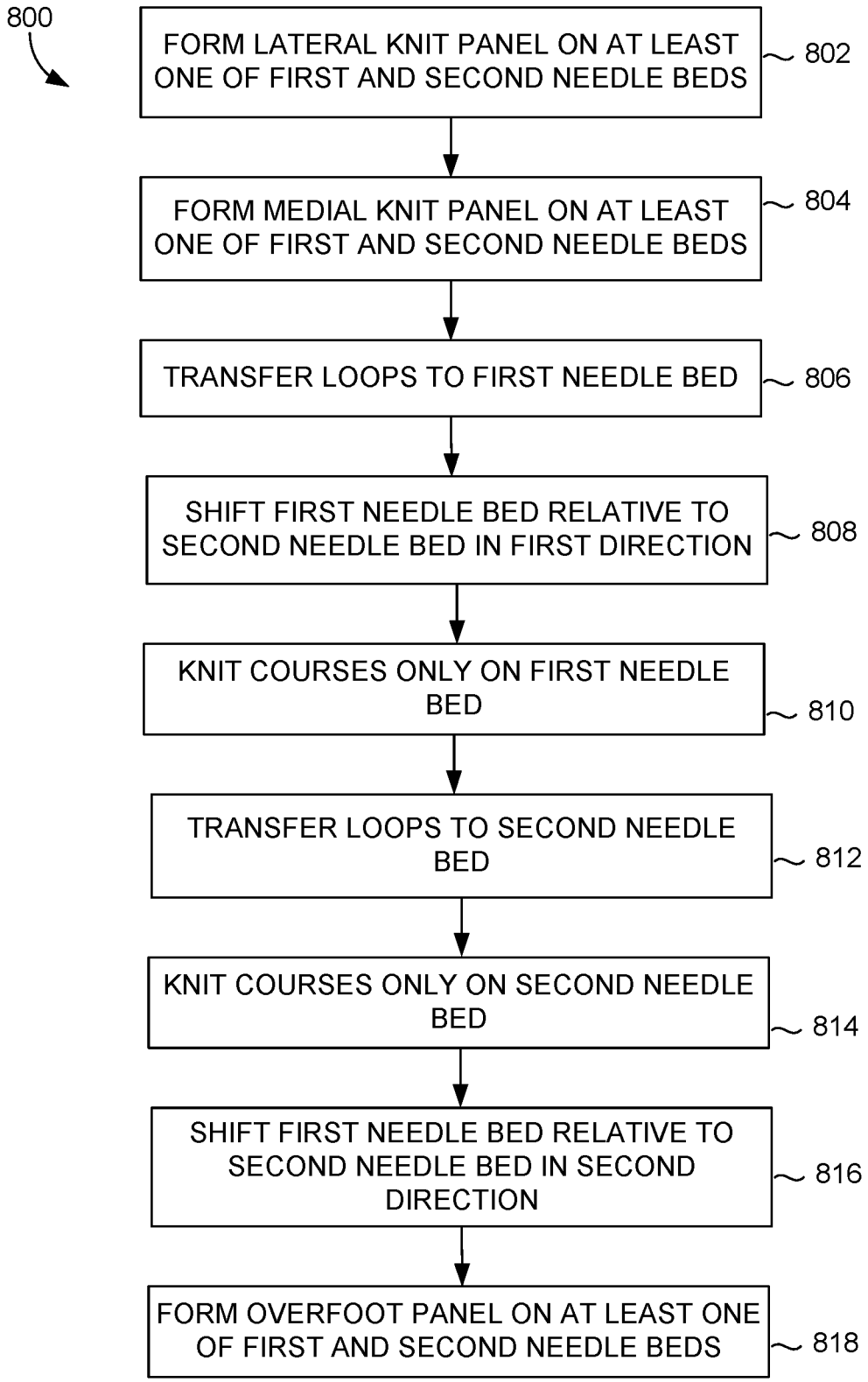
FIG. 13 depicts a representation of a method of manufacturing the knitted upper component of FIG. 11 in accordance with aspects herein.

FIG. 13 illustrates a flow diagram depicting an example method 800 of manufacturing a knitted upper component with integrally knit pleats or folds, such as the knitted upper component 200. The steps provided in method 800 are merely illustrative, and method 800 may include additional steps that are not illustrated. At least some of the steps of method 800 are indicated as being performed on a knitting machine, which may be an automated knitting machine. As such, one or more of these steps may be performed and/or controlled using a control unit having a processor or computer communicatively coupled with or integrated into the knitting machine. In example aspects, the knitting machine used to carry out steps of method 800 is a V-bed flat knitting machine having two needle beds—a front needle bed and a back needle bed—that are angled relative to each other to form a V-bed. The front and back needle beds may each include a plurality of individual needles extending across a common plane. A carriage may move feeders, such as standard and/or combination feeders, along the front and back needle beds to supply yarns to needles. Generally, standard feeders and combination feeders both supply yarn for needles to knit, tuck, and/or float, while combination feeders may also supply yarn to inlay through or between knitted structures. Although a flat V-bed knitting machine used for weft-knitting is described herein, it should be understood that this is one example and that other knitting machines may be used be used to form the knitted upper component or a portion thereof.

At step 802 of method 800, a lateral knit panel (which may be an example of the lateral knit panel 204) is knit using one of a first needle bed and a second needle bed, and at step 804, a medial knit panel (which may be an example of the medial knit panel 206) is knit on at least one of the first needle bed and the second needle bed. In some aspects, the first needle bed is the front needle bed and the second needle bed is the back needle bed, but it should be understood that the first needle bed may be the back needle bed while the second needle bed may be the front needle bed. In some aspects of method 800, the lateral knit panel and the medial knit panel are each knit on both the first needle bed and the second needle bed. In one aspect, the lateral and medial knit panels both have double jersey knit structure. Additionally, the lateral knit and medial knit panels may be knit at steps 802 and 804 in a heel-to-toe direction such that the portions that will form part of the heel region of the knitted upper component are knit prior to the portions that will form part of the toe region of the knitted upper component. In some aspects, some part of the lateral knit panel and/or medial knit panel may be formed on a single needle bed but another portion, such as a portion in the toe region, is knit on both needle bed.

At step 806, once the lateral and medial knit panels are knit through a toe portion (e.g., toe region 102), loops forming the lateral and medial knit panels that are on the needles of the second needle bed are transferred to needles on the first needle bed. After this transfer, the needles on the second needle bed may remain empty.

At step 808, the first needle bed is shifted horizontally relative to the second needle bed in a first direction by a number of needle positions. This shifting may be also referred to as racking the needle beds. To accomplish step 808, the first needle bed may be moved while the second needle bed remains stationary, the second needle bed may be moved while the first needle bed remains stationary, or both needle beds may be moved. In some aspects, the number of needle positions over which the first and second needle beds are racked at step 808 is within a range of 4 to 12. In some aspects, the number of needle positions is within a range of 6 to 10, and in one example aspect, the number of needle positions is 8.

After the needle beds are shifted relative to one another, a quantity of courses is knit on only the first needle bed at step 810. In some aspects, the quantity of courses that is knit on the first needle bed at step 810 is within a range of 1 to 5. In one example, the quantity of courses knit at step 810 is 2.

A step 812, all loops from the first needle bed are transferred to the second needle bed, and at step 814, a second quantity of courses are knit on only the second needle bed. The quantity of course knit at step 814 may be the same quantity previously knit at step 810. In some aspects, the second quantity of courses is within a range of 1 to 5. In one example, the second quantity of courses knit at step 814 is 2.

At step 816, the needle beds are shifted back such that the first needle bed is shifted relative to the second needle in a second direction by the same number of needle positons the beds were shifted in the first direction at step 808. For example, at step 816, the needle beds may be shifted in the second direction by 8 needle positons. The second direction is the opposite the first direction such that the first and second needle beds may be aligned similar to one another as they were prior to step 808.

At step 818, an overfoot knit panel, which may be an example aspect of the knit overfoot panel 202, is knit on at least one of the first needle bed and the second needle bed. In some aspects, the overfoot knit panel is knit using both the first needle bed and the second needle bed. In one aspect, the overfoot knit panel has a double jersey knit structure. In exemplary aspects, the gauge (or density of active needles being used along a needle bed when knitting) is uniform when knitting the lateral knit panel, the medial knit panel, and the overfoot knit panel at steps 802, 804, and 818, respectively. Further, in some aspects, the gauge knit in these steps is a full gauge.

In some aspects, method 800 also includes knitting a lower knit panel that is positioned between the medial knit panel and the lateral knit panel. The lower knit panel (which may be an example of lower knit panel 208) may be knit so that courses are knit continuously from the medial knit panel, through the lower knit panel, and to the lateral knit panel and vice versa. In this way, the lower knit panel, the medial knit panel, and the lateral knit panel may be formed simultaneously using the same yarn feeder(s). Additionally, in some aspects, where the lower knit panel does not integrally connect the lateral knit panel and the medial knit panel, the lateral knit panel and the medial knit panel may be formed at the same time with different yarn feeders. In other aspects, the medial knit panel and the lateral knit panel may be formed separately such that one of these panels may be knit first and held on the needles while the other panel is knit.

Steps 806-816 represent where the medial and lateral knit panels are integrally knitted with the overfoot knit panel and how integrally knit pleats (e.g., pleats 242 and 244) may be formed. Shifting the needle beds at steps 808 and 816 result in additional tension or a pull that causes a fold to be created where the medial and lateral knit panels are knit with the overfoot knit panel. Additionally, in aspects in which a lower knit panel is created, switching from a double knit jersey construction in the lower knit panel, to the single jersey knit construction for the pleats (i.e., in a transition between the lower knit panel and overfoot knit panel), and back to a double knit jersey construction for the overfoot knit panel results in the knitted upper component being biased to curl and form a contoured shape at the transition between the lower knit panel and the overfoot panel.

Aspects of the knitted upper component 200 include integrally knit lace tunnels 600 that, along with the lace 150, form a lacing system for securing the upper 110 around a wearer's foot. The overfoot knit panel 202, the lateral knit panel 204, and the medial knit panel 206 each have integrally knit lace tunnels 600. In exemplary aspects, each lace tunnel 600 is a raised tubular structure formed between two coextensive knit layers of the knitted upper component 200. In regions adjacent the lace tunnels 600, the two knit layers may be interconnected such that they are not freely separately, but the two knit layers may be separable from one another in the lace tunnels to form a channel 602 between the two knit layers. The channel 602 may be configured to receive the lace 150.

The channel 602 of each lace tunnel 600 extends from a first end 604 to a second end 606 of the lace tunnel 600. The length 608 of any lace tunnel 600 is between the first end 604 and the second end 606. In some aspects, at least one lace tunnel 600 on each of the overfoot knit panel 202, the lateral knit panel 204, and the medial knit panel 206 has the same length. Further, all of the lace tunnels 600 may have the same length 608. In some aspects, the channels 602 of the lace tunnels 600 extend in a course-wise direction and, as such, may have lengths 608 measured by a quantity of wales between the first end 604 and the second end 606. The lengths 608 of all lace tunnels 600 may be within a range from about 4 wales to about 16 wales, within a range from about 4 wales to about 14 wales, or within a range from about 6 wales to about 10 wales. In one example in which the lace tunnels 600 have uniform lengths, the length 608 may be about 8 wales.

Figure 14:
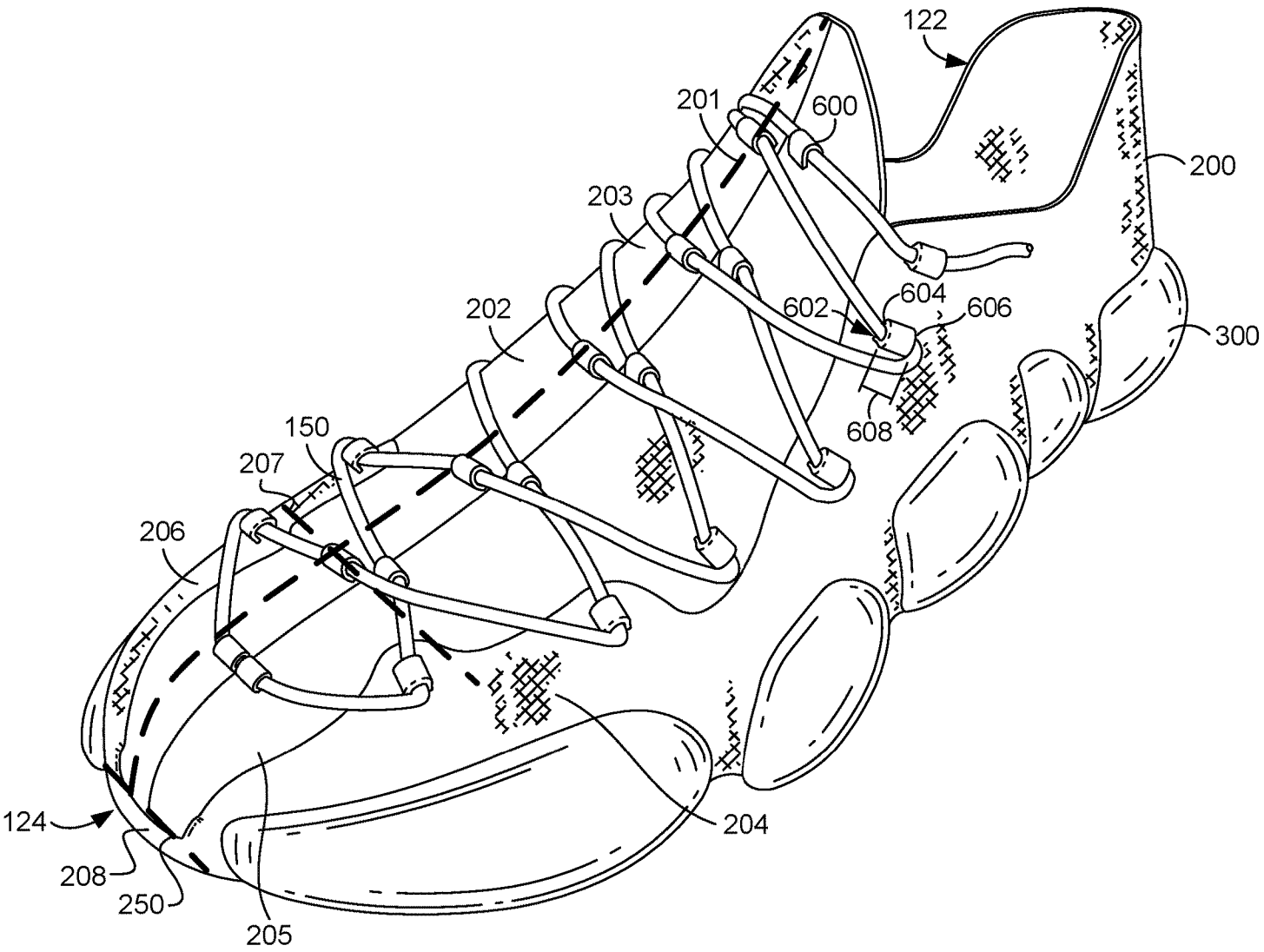
FIG. 14 depicts a lateral side perspective view of the knitted upper component of FIG. 12 with a lacing system in accordance with aspects herein.

The overfoot knit panel 202 may extend from the ankle opening 122 to the lower knit panel 208 at the anterior portion 124 of the toe region 102. As such, the overfoot knit panel 202 may have a length (shown by dashed line 201 in FIG. 14) extending from the ankle opening 122 to the lower knit panel 208 at the anterior portion 124 of the toe region 102. The overfoot knit panel 202 may have a tongue portion 203 forming approximately the posterior two-thirds of the overfoot knit panel 202, and a vamp portion 205 forming approximately the anterior one-third of the overfoot knit panel 202, where the vamp portion 205 and the tongue portion 203 are separated by dashed line 207 for illustration purposes only in FIG. 14. As such, the tongue portion 203 may extend from the ankle opening 122 to approximately two-thirds of the length 201 of the overfoot knit panel, and the vamp portion 205 may extend from the transition (e.g., joined are 250) with the lower knit panel 208 to approximately one-third the length 201 of the overfoot knit panel 202. As such, the overfoot knit panel 202 may include at least one lace tunnel in the anterior-most third of the overfoot knit panel 202. In some aspects, the boundary between the tongue portion 203 and the vamp portion 205 is configured to align with metatarsophalangeal joints of the wearer when the footwear 100 is worn. As such, the overfoot knit panel 202 may include at least one lace tunnel 600 that is positioned to be over the wearer's toes when the footwear 100 is worn.

The medial knit panel 206 and the lateral knit panel 204 may each include lace tunnels 600 extending from the midfoot region 104 to the toe region 102. In the example in FIG. 14, there are five lace tunnels 600 on each of the medial knit panel 206 and the lateral knit panel 204, but it contemplated that other aspects may include different amounts of lace tunnels 600. Additionally, the overfoot knit panel 202 includes lace tunnels 600 arranged in pairs.

In some aspects, the medial knit panel 206 includes a medial-panel top edge 224, and the lateral knit panel 204 includes a lateral-panel top edge 214, where at least some of the lace tunnels 600 are located adjacent the medial-panel top edge 224 and lateral-panel top edge 214. Positioning the lace tunnels 600 through the knitted upper component 200 adjacent the lateral-panel and medial-panel top edges 214 and 224 and through the disclosed positioned on the overfoot knit panel 202 helps to keep the knitted upper component 200 contained around a wearer's foot. This ability may be particularly advantageous to keep the knitted upper component 200 provide containment around a wearer's foot where the knitted upper component 200 extends at least partially around the midsole component 300.

Figure 15:
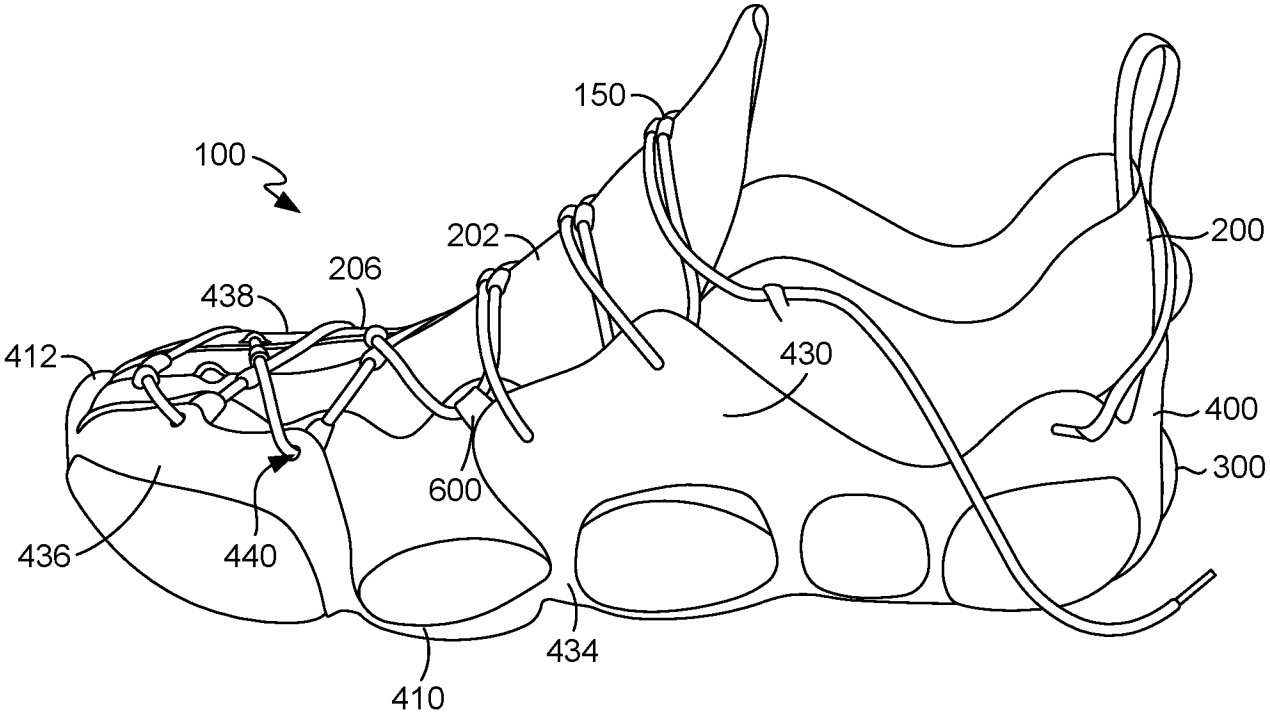
FIG. 15 depicts a lateral side view of the exterior sole component laced to the knitted upper component in accordance with aspects herein.

FIG. 15 depicts a lateral side view of footwear 100 with the knitted upper component 200, the midsole component 300, and the exterior sole component 400. As illustrated, the lace 150 may be used to secure the exterior sole component 400 to the knitted upper component 200. In this way, the lace 150 may provide another means by which the exterior sole component 400 is coupled to the rest of the footwear 100 in addition to having openings (e.g., openings 420) that receive protrusions 312 on the midsole component 300.

With reference to FIG. 15, as well as FIG. 7A, the upper portion 412 of the exterior sole component 400 includes a medial top edge portion 432 that is positioned adjacent the medial side 118 of the knitted upper component 200 within in an instep region and includes a lateral top edge portion 430 that is positioned adjacent the lateral side 116 of the knitted upper component 200 within the instep region. An intermediate portion 434 of the exterior sole component 400 extends between the medial top edge portion 432 and the lateral top edge portion 430. The intermediate portion 434 is at least partially formed of the underfoot portion 410 of the exterior sole component 400 and, therefore, may be part of the ground-contacting surface.

Each of the medial top edge portion 432 and the lateral top edge portion 430 include a lacing engagement portion. In example aspects, the lacing engagement portion is a lace aperture 440 through which the lace 150 extends. The lace aperture 440 may be an opening directly within the exterior sole component 400. In other aspects, the lace apertures are formed by additional components, which as loops formed by cables or other materials, that are secured to the medial top edge portion 432 and the lateral top edge portion 430 of the exterior sole component 400.

The upper portion 412 of the exterior sole component 400 may further include a second lateral top edge portion 436 and a second medial top edge portion 438. The second lateral top edge portion 436 may be positioned on the lateral side 404 and positioned along the toe region 102 of the knitted upper component 200. The second medial top edge portion 438 may be positioned on the medial side 402 and positioned along the toe region 102 of the knitted upper component 200. A second intermediate section 444 forms part of the underfoot portion 410 and extends between the second lateral top edge portion 436 and the second medial top edge portion 438. Additionally, the second lateral top edge portion 436 and the second medial top edge portion 438 may also include lace engagement portions (e.g., lace apertures 440) similar to the lateral top edge portion 430 and the second medial top edge portion 440.

The lace 150 that extends through lace apertures (e.g., lace tunnels 600) on the knitted upper component 200 may also extend through lace apertures 440 on the exterior sole component 400 so that the lace 150 provides a means for removably coupling the exterior sole component 400 with the knitted upper component 200. In some aspects, the exterior sole component 400 is aligned with the knitted upper component 200 so that the lace apertures 440 on the exterior sole component 400 (e.g., apertures 440 on at least the lateral top edge portion 430 and the medial top edge portion 432) are positioned immediately adjacent to lace tunnels 600 in the lateral knit panel 204 and the medial knit panel 206, respectively. In some aspects, lace apertures 440 on the second lateral top edge portion 436 and the second medial top edge portion 438 are positioned immediately adjacent to lace tunnels 600 in the lateral knit panel 204 and the medial knit panel 206, respectively.

Figure 16A:
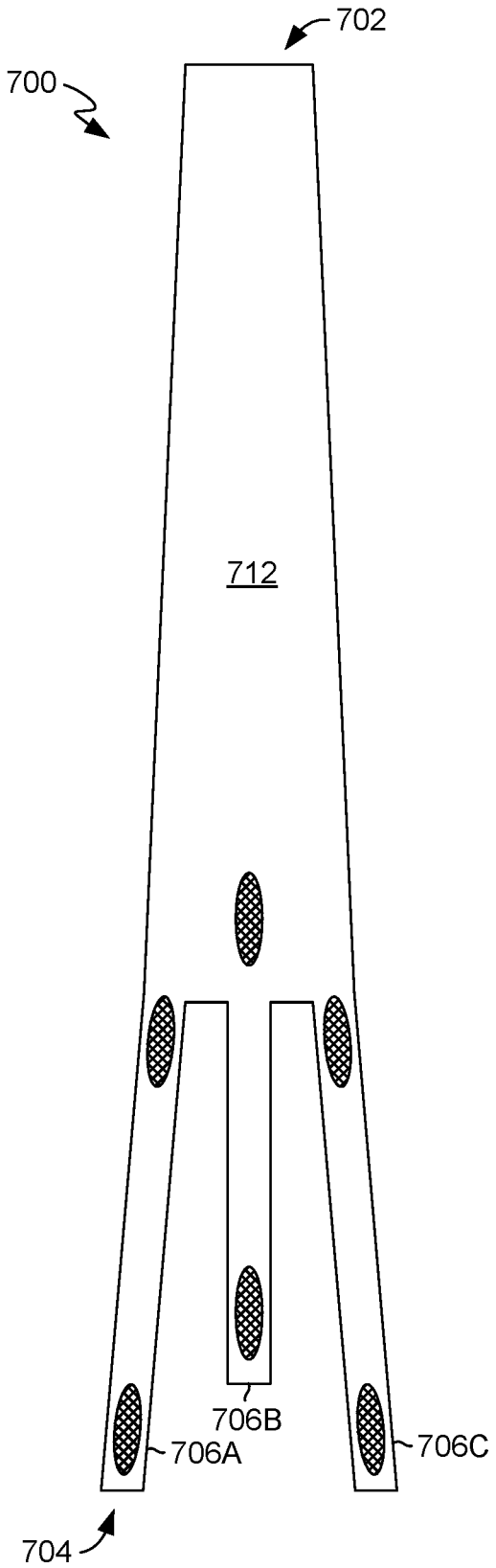
FIGS. 16A and 16B depict an example textile piece for a heel strap for the article of footwear in accordance with aspects herein.
Figure 16B:
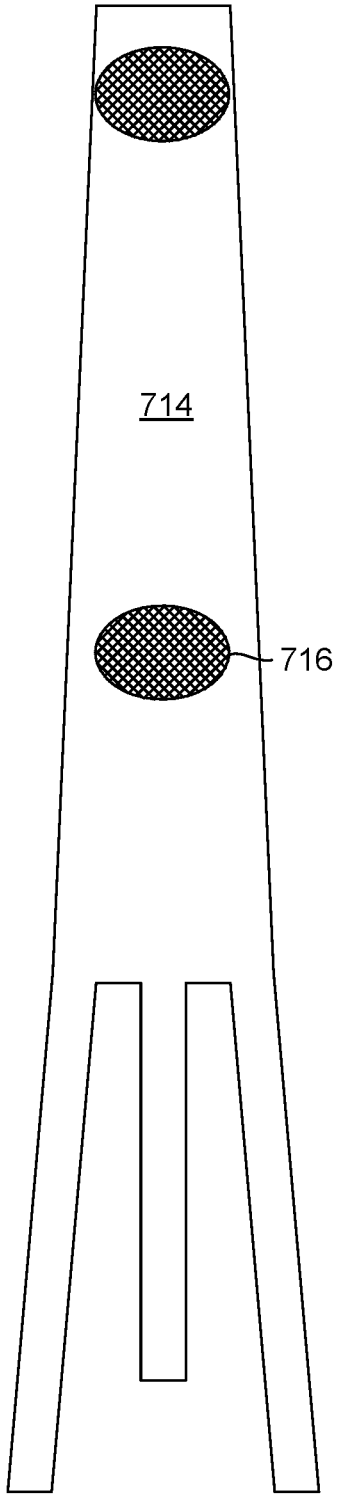

FIGS. 16A and 16B depict an example heel strap 700 that may be incorporated into the footwear 100. The heel strap 700 may be a textile piece, such as a knitted textile, forming a first surface 712 and a second surface 714. The heel strap 700 has a generally elongate shape having a first end 702 and a second end 704. The second end 704 may split into three branches 706A, 706B, and 706C. These branches 706A, 706B, and 706C fold over themselves so that distal ends of the branches 706A, 706B, and 706C may be secured to proximate ends of the branches (such as for branches 706A and 706C) or secured to a portion of the heel strap 700 adjacent the branched section (such as for branch 706B). Additionally, the first end 702 of the heel strap 700 may fold over itself and be secured to another portion of the heel strap 700 between the first end 702 and the second end 704. Hatched markings in FIGS. 16A and 16B illustrate example locations in which the heel strap 700 may be secure to itself. In some aspects, this securing is done through stitching but it is contemplated that other means of removably or permanently securing the heel strap 700 to itself may be used. For example, hook and loop fasteners, buttons, magnets, ties, and/or snap fasteners may be incorporated as means for removably securing various portions of the heel strap 700 to itself or another component, such as the knitted upper component 200.

Figure 17:
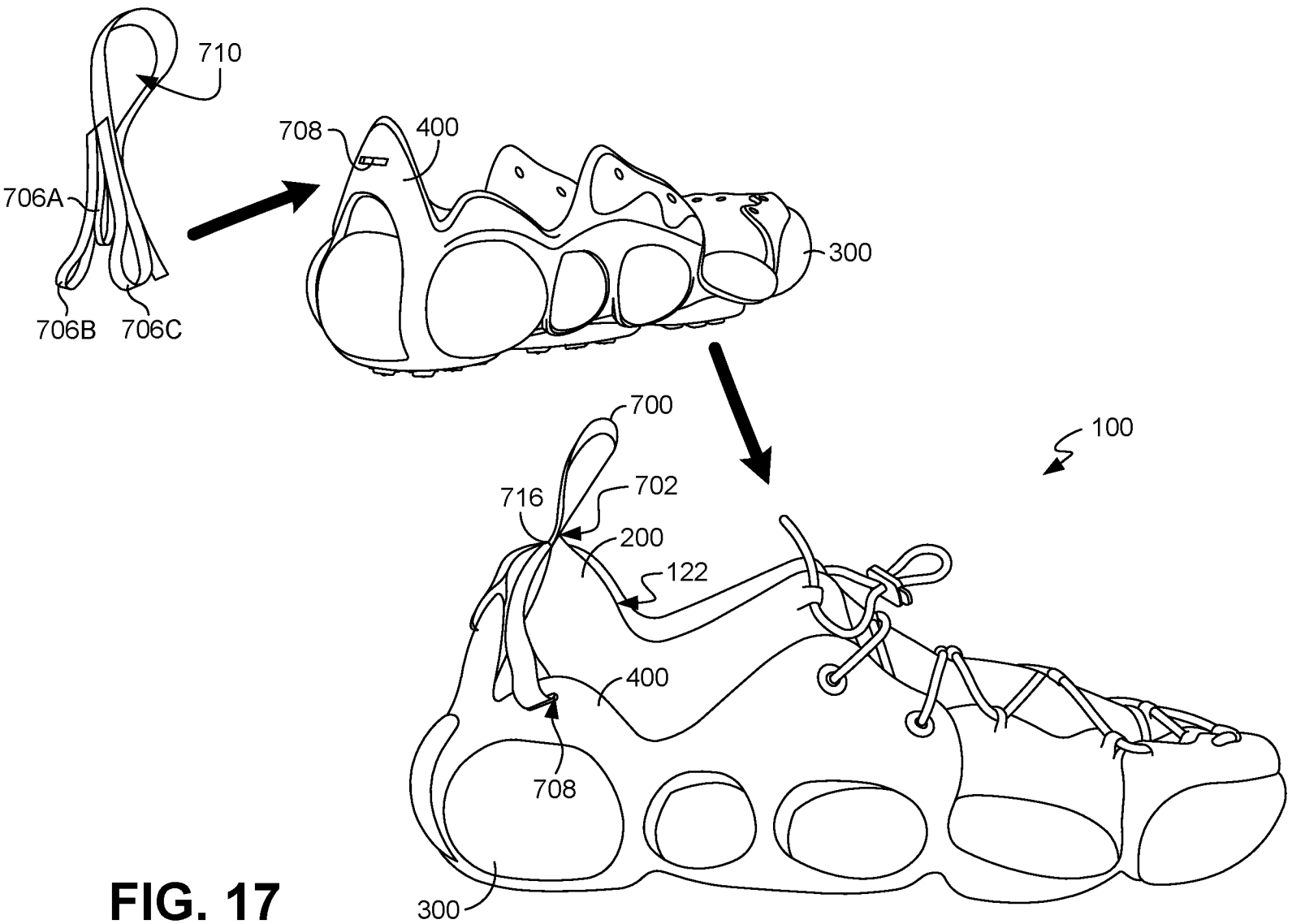
FIG. 17 depicts a schematic diagram representing how the heel strap of FIGS. 16A and 16B is integrated into the article of footwear in accordance with aspects herein.

FIG. 17 depicts how the heel strap 700 may be integrated into the footwear 100. The exterior sole component 400 includes three slots 708. Each of the three branches 706A, 706B, and 706C may be threaded through a slot 708 and then secure to itself as described above. The first end 702 of the heel strap 700 may be folded over itself to form the strap loop 710, which may be used by a wearer to pull up on the heel strap 700 when donning the footwear 100. In some aspects, the heel strap 700 is not directly secured to the knitted upper component 200. In other aspects, the first end 702 of the heel strap 700 is folded over itself to form the strap loop 710 and inserted, through the ankle opening 122, into interior chamber defined by the knitted upper component 200. The first end 702 may be secured to the inside of the knitted upper component 200. In some aspects, an intermediate section 716 of the heel strap 700 may be secured to the exterior surface of the knitted upper component 200 while the first end 702 is secured to the interior surface. Although the heel strap 700 is depicted in several drawings herein, it should be understood that aspects of footwear 100 and its components described herein may not include the heel strap 700. Further, the knitted upper component 200 is removed from the top portion of FIG. 17 only to not distract from the features of the heel strap 700 and the exterior sole component 400 but it should be understood that the heel strap 700 may be integrated with the knitted upper component 200 as illustrated in the bottom portion of FIG. 17.

Figure 18A:
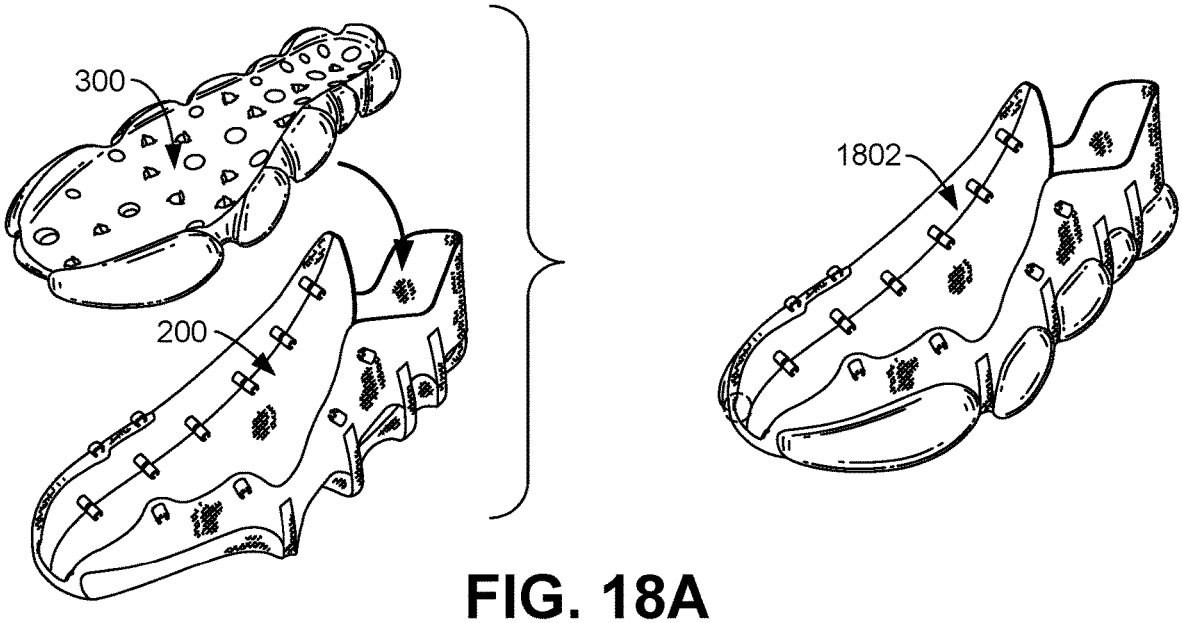
FIGS. 18A-18C depict knit-component tolerances across an array, in accordance with aspects herein.
Figure 18B:
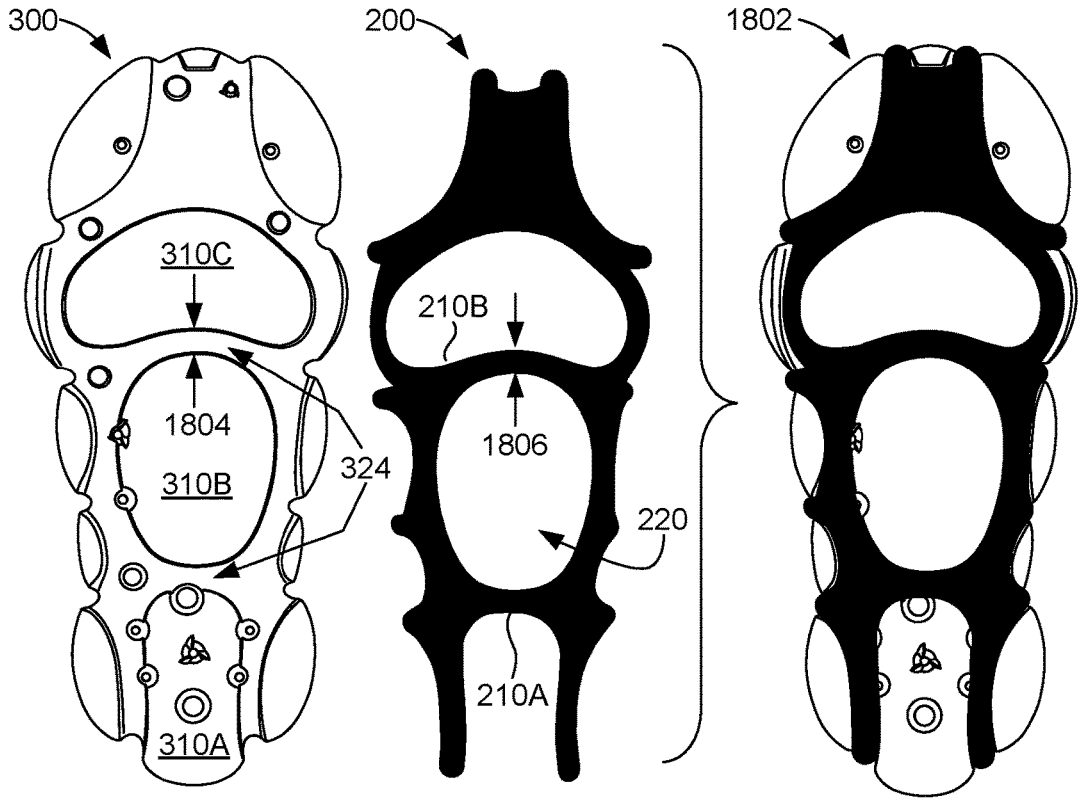
Figure 18C:
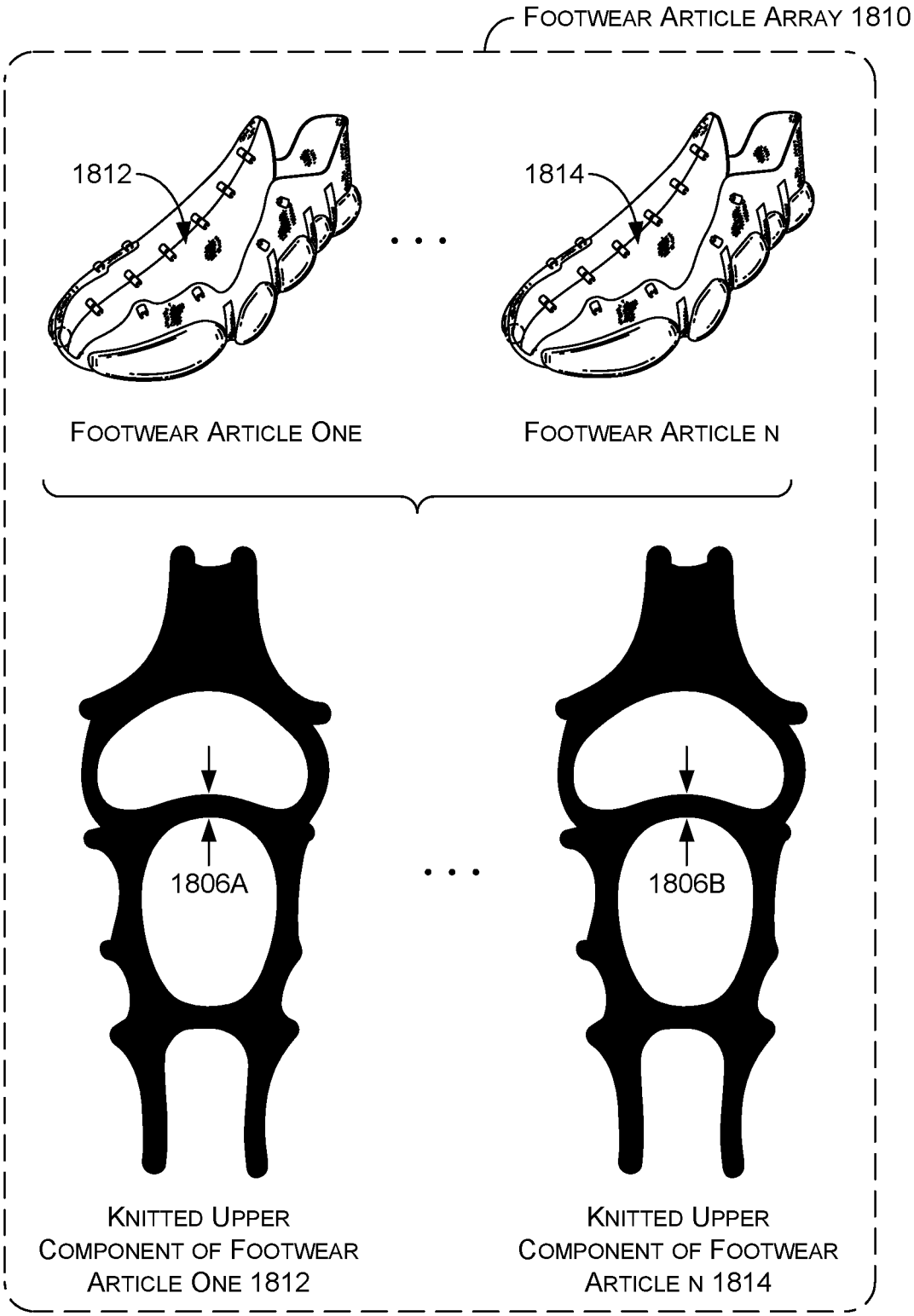

Referring now to FIGS. 18A, 18B, and 18C, another aspect of the present disclosure is illustrated. FIGS. 18A and 18B depict the knitted upper component 200 and the midsole component 300, and as described in other portions of this disclosure, the midsole component 300 can be combined with the knitted upper component 200 to form at least a footwear assembly 1802. In addition, the midsole component 300 can include the protrusions 310A, 310B, and 310C, and recesses 324 located between the protrusions. Furthermore, in some examples, the knitted upper component 200 can include knit strips 210A and 210B that, in the assembly 1802, nest within the recesses 324 between adjacent protrusions 310 of the midsole component 300.

In some examples, the protrusions 310A, 310B, and 310C and/or the recesses 324 can include size dimensions, such as the recess width 1804. In addition, the knit strips 210A and 210B can include a size dimension, such as the strip width 1806. In examples of the present disclosure, the strip width 1806 can influence the nesting relationship between the knitted upper component 200 and the midsole component 300. For example, if the strip width 1806 is larger than the recess width 1804 by an amount greater than a given tolerance (e.g., more than 20 percent), then the knit strips 210 will not be able to nest within the recesses 324. Further, if the strip width 1806 is smaller than the recess width 1804 by an amount greater than a given tolerance (e.g., more than 20 percent), then the knit strips 210 will be more likely to at least partially dislodge from the recesses 324. Stated differently, because examples of the present disclosure do not include adhesives or other bonding agents to couple the knitted upper component 200 to the midsole component 300, the closeness of the fit (e.g., based on the similarity between the strip width 1806 and the recess width 1804) between the knitted upper component 200 and the midsole component 300 can improve the integrity of the assembly 1802.

In at least some examples, the midsole component 300 includes a recess (e.g., 324) with a recess width (e.g., 1804); the knitted upper component 200 includes a knit strip (e.g., 210B) with a strip width (e.g., 1806); and the strip width 1806 is within a width tolerance of the recess width. In examples, the width tolerance is within about 0.5 millimeter and about 1.5 millimeters, or within about 0.75 millimeter and about 1.25 millimeters, or about 1 millimeter. For example, if the recess width is about 10 millimeters, then the strip width can be about 8 millimeters to about 11.5 millimeters.

Referring to FIG. 18C another example is illustrated, including an array 1810 of articles of footwear (e.g., assembly 1802 or combination of assembly 1802 with an outsole component, such as the exterior sole component 400), including footwear article one 1812 and footwear article "n" 1814. The array 1810 can include a batch of articles of footwear, such as a batch provided by a manufacturer, distributor, retailer, etc. The array 1810 can include various quantity of footwear articles, and in some examples, "n" can be more than five, more than ten, or more than twenty. As described with respect to FIGS. 18A and 18B, the similarity of the recess width 1804 and strip width 1806 can affect the integrity of the assembly. As such, among the array 1810, the strip widths between any two knitted component uppers within the array (e.g., strip width 1806A and strip width 1806B) can include a relatively small standard deviation. For example, in some instances, the standard deviation can be in a range of about 0.5 millimeter to about 1 millimeters, or about 1.25 millimeters to about 0.75 millimeter, or about 1.2 millimeters or about 1.0 millimeter.

In some examples, tolerances and deviations among an article of footwear may vary depending on the portion of the upper. For example, as explained above, to improve the nesting relationship and securement between the knitted upper component 200 and the midsole component 300, the strip width 1806 may have relatively smaller tolerances and standard deviations among an array. In some examples, other portions of the upper, such as on the medial and lateral knit panels (e.g., panels 204 and 206) or the overfoot panel (e.g., panel 202), the knit portions may have larger tolerances and standard deviations that are between about 3 millimeters and 6 millimeters (e.g., more than double the tolerance for the strip width 1806).

Figure 19A:
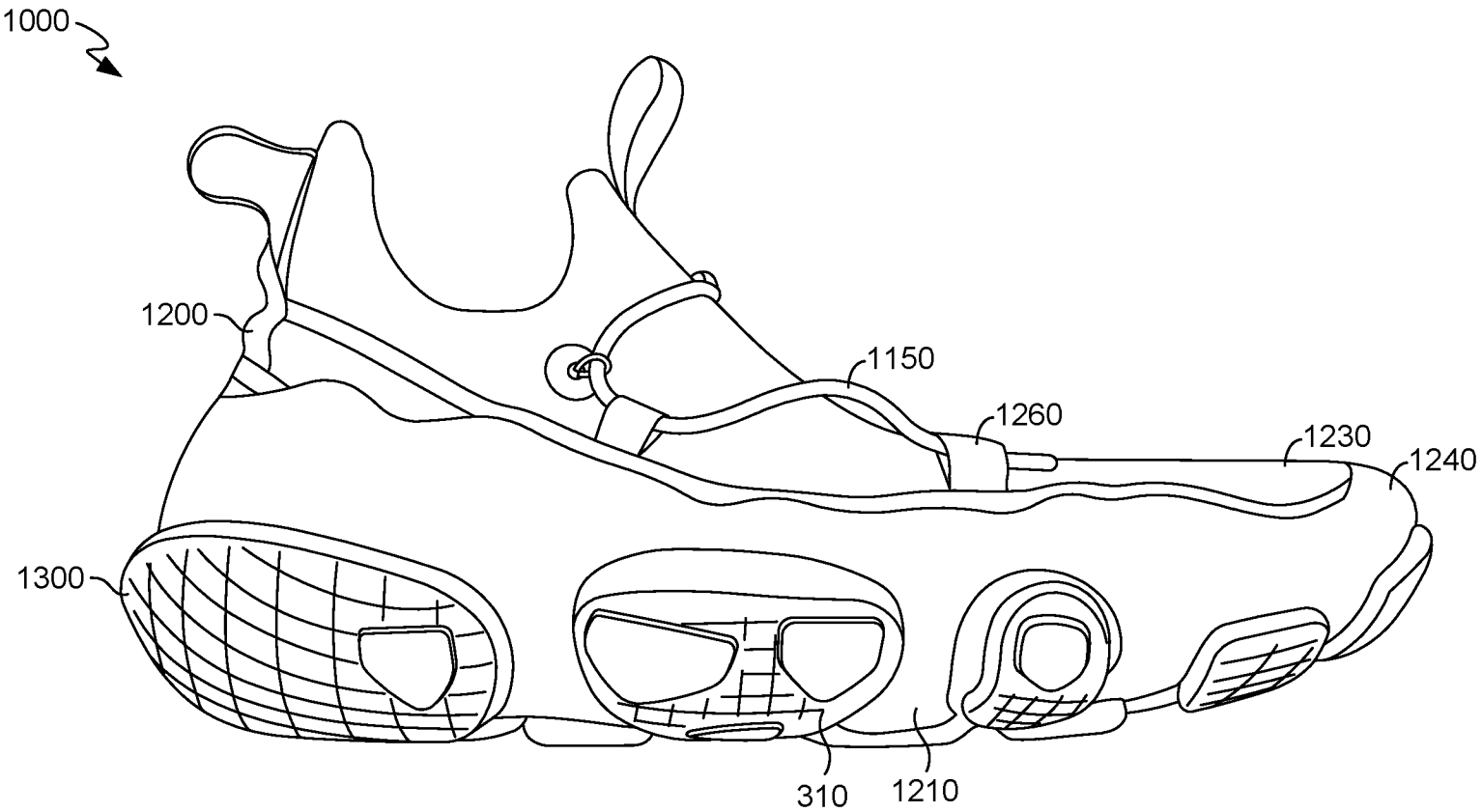
FIGS. 19A-19C depict alternative embodiments of an article of footwear in accordance with aspects herein.
Figure 19B:
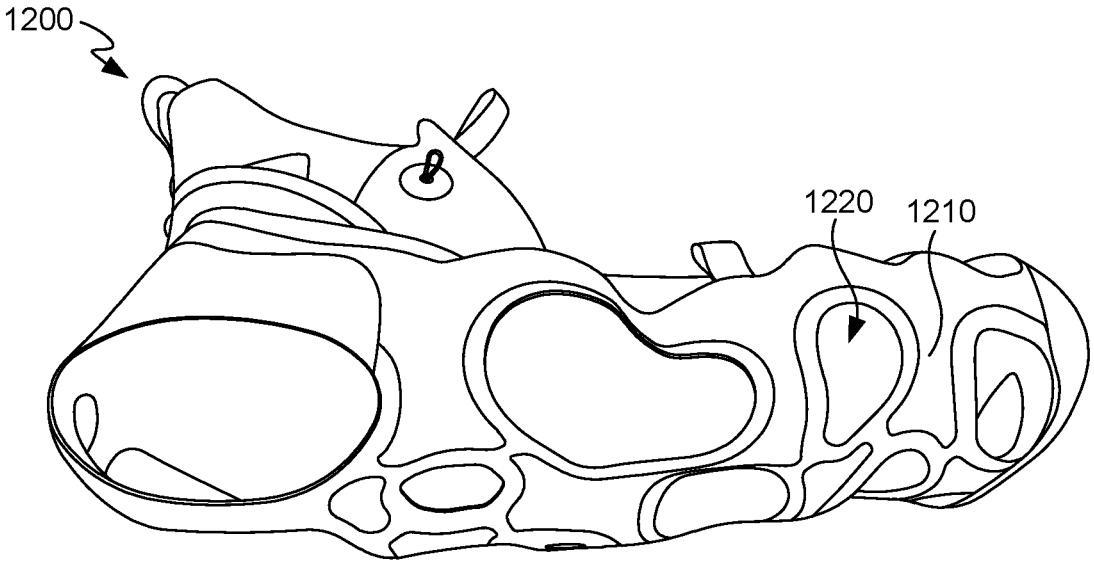
Figure 19C:
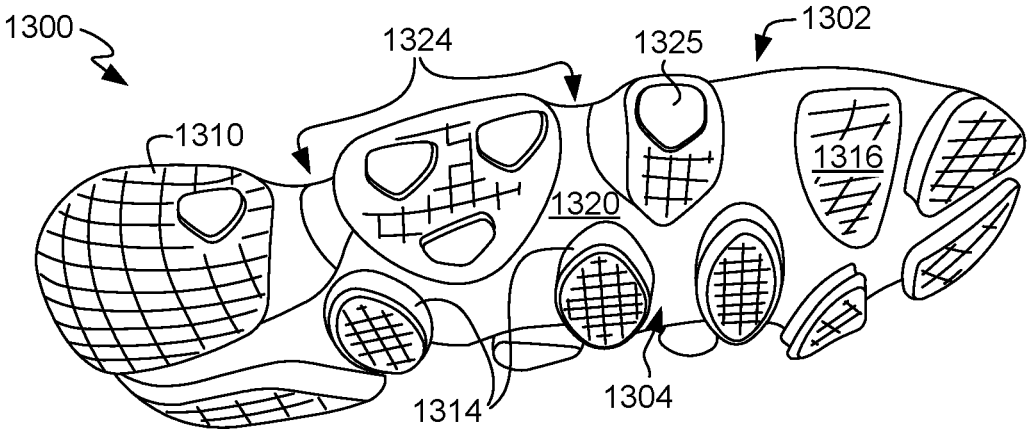

FIGS. 19A, 19B, and 19C depict views of an alternative footwear embodiment. Footwear 1000 may include a knitted upper component 1200 similar to the knitted upper component 200 described herein and a midsole component 1300 similar to the midsole component 300 described herein. The midsole component 1300 may be positioned within the interior chamber defined by the knitted upper component 1200 and have protrusions extending through the openings in the knitted upper component 1200 as further described below. The coupling of the midsole component 1300 and knitted upper component 1200 may be similar to what is described for the midsole component 300 and the knitted upper component 200. As such, the knitted upper component 1200 (forming an upper of the footwear 100) and the midsole component 300 (forming a sole structure of the footwear 100) may be coupled together without the use of adhesive or stitching to allow for easy deconstruction as well as construction of the footwear. Further, materials forming the knitted upper component 1200 and the midsole component 1300 may recycled materials, such as materials recycled from no longer existing components in footwear as described with respect to FIG. 9. Additionally or alternatively, the knitted upper component 1200 and/or the midsole component 1300 may be re-used from a different footwear assembly as these components may be swapped out between different footwear assemblies. Aspects of footwear 1000 do not include an exterior sole component such that the midsole component 1300 may form the ground-contacting surface. It should be understood that embodiments described with respect to footwear 100 may also not include an exterior sole component.

FIG. 19B provides a bottom perspective view of the knitted upper component 1200. The knitted upper component 1200 includes an overfoot portion 1230 and a lower portion 1240. The overfoot portion 1230 forms a superior aspect of the knitted upper component 1200 in that it extends over the top and at least partway down the lateral and medial sides of a wearer's foot when the footwear 1000 is being worn. The lower portion 1240 is configured to extend underneath a wearer's foot (either directly or separated by one or more sole components). The lower portion 1240 extends through a toe region (similar to the toe region 102), a midfoot region (similar to the midfoot region 104), and a heel region (similar to the heel region 106). Together, the overfoot portion 1230 and the lower portion 1240 define an interior chamber that may be accessed at least through the ankle opening 122. The interior chamber may receive the midsole component 1300 as well as the wearer's foot. The overfoot portion 1230 and the lower portion 1240 may be knitted as separate components and secured (e.g., stitched) together. Alternatively, the overfoot portion 1230 and the lower portion 1240 may be integrally knit together such that they form a continuous knit structure as described with respect to the knitted upper component 200.

As seen in the view of the footwear 1000 depicted in FIG. 19A, the knitted upper component 1200 may have a sock-like structure and may not have an overfoot knit panel that is substantially unsecured to the lateral and medial sides. The knitted upper component 1200 may include lace tunnels 1260 for receiving a lace 1150 to help secure the footwear 100 to a desired fit around the wearer's foot. In some aspects, the lace tunnels 1260 are positioned at a transition between the overfoot portion 1230 and the lower portion 1240.

The lower portion 1240 of the knitted upper component 1200 includes integrally knit strips 1210 forming a bottom side of the knitted upper component 1200. The knit strips 1210 define openings 1220 in the knitted upper component 1200 that receive portions of the midsole component 1300.

FIG. 19A depicts a bottom perspective view of the midsole component 1300. The midsole component 300 includes a top side 1302, a bottom side 1304 that includes a plurality of protrusions 1310, similar to protrusions 310 described above. The protrusions 1310 extend outward from a recessed bottom surface 1320 of the bottom side 1304 and toward a ground, floor or other external surface when the footwear 100 is worn. Each protrusion 1310 includes a protruding bottom surface 1316 that forms the surface of the protrusion 1310 that is farthest form the top side 1302, and also includes side walls 1314 that extend between the surface 1316 and the recessed bottom surface 1320. Recesses 1324 (or grooves) are formed between side walls 1314 of adjacent protrusions 1310. The midsole component 1300 includes protrusions 1310 and recesses 1324 in the toe region, the midfoot region, and the heel region. In some aspects, some of the protrusions 1310 have one or more additional protrusions 1325 that have a smaller surface area as the primary protrusions 1310 and extend further away from the recessed surface 1320.

When the midsole component 1300 is inserted within the interior cavity of the knitted upper component 1200, the protrusions 1310 extend through the openings 1220 defined at least partially by the knit strips 1210 of the knitted upper component 1200. When assembled as shown in FIG. 19A, the knit strips 1210 extend within the recesses 1320 between protrusions 1310 to mechanically couple and secure the midsole component 1300 within the knitted upper component 1200.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1: An article of footwear comprising a knitted upper component, the knitted upper component comprising: a medial side; a lateral side; a medial knit panel forming at least part of the medial side of the knitted upper component and having a medial-panel top edge; a lateral knit panel forming at least part of the lateral side of the knitted upper component having a lateral-panel top edge; an overfoot knit panel positioned between the medial knit panel and the lateral knit panel; and a plurality of lace tunnels comprising: one or more lace tunnels positioned on the overfoot knit panel, one or more lace tunnels adjacent the medial-panel top edge of the medial knit panel, and one or more lace tunnels adjacent the medial-panel top edge of the lateral knit panel.

Clause 2: The article of footwear of clause 1, further comprising a lace extending through each of lace tunnels in the plurality of lace channels.

Clause 3: The article of footwear of any of clauses 1 and 2, wherein a single lace extends through each lace tunnel in the plurality of lace tunnels.

Clause 4: The article of footwear of any of clauses 1-3, further comprising a midsole component positioned within an interior void formed by the knitted upper component.

Clause 5: The article of footwear of clause 4, wherein a lower portion of the knitted upper component includes apertures, wherein protrusions extending from a bottom side the midsole component extend through the apertures in the lower portion of the knitted component.

Clause 6: The article of footwear of any of clauses 4-5, wherein the midsole component and the knitted upper component are joined together without adhesives.

Clause 7: The article of footwear of any of clauses 1-6, wherein the lace tunnels within the plurality of lace tunnels are integrally knit with one or more portions of the knitted upper component.

Clause 8: The article of footwear of any of clauses 1-7, wherein the medial knit panel, the lateral knit panel, and the overfoot knit panel are integrally knit in a unitary construction.

Clause 9: An article of footwear comprising: a first knitted upper component comprising a set of yarns derived from a no-longer existing knitted upper component, the first knitted upper component at least partially defining an interior chamber configured to receive a wearer's foot and having a lower portion with knit strips defining a first plurality of openings; and a first midsole component comprising a first thermoplastic polymer material component recycled from a no-longer existing midsole component, the first midsole component received in the interior chamber of the knitted upper component and having a plurality of protrusions extending through the first plurality of openings in the first knitted upper component.

Clause 10: The article of footwear of clause 9, wherein adjacent protrusions within the plurality of protrusions are separated by recessed surfaces of the first midsole component and, wherein the lower portion of the first knitted upper component are positioned under and contact the recessed surfaces of the first midsole component.

Clause 11: The article of footwear of any of clauses 9-10, wherein the set of yarns of the first knitted upper component comprises polyester yarns.

Clause 12: The article of footwear of any of clauses 9-11, wherein the first thermoplastic polymer material component comprises thermoplastic polyurethane (TPU).

Clause 13: The article of footwear of any of clauses 9-12, wherein the first midsole component and the first knitted upper component are joined together without adhesives.

Clause 14: The article of footwear of any of clauses 9-13 further comprising a first exterior sole component extending under at least part of the first knitted upper component and having one or more openings for receiving a subset of protrusions from the plurality of protrusions of the first midsole component.

Clause 15: The article of footwear of clause 14, wherein the first exterior sole component comprises a thermoplastic polymer material.

Clause 16: The article of footwear of any of clauses 14-15, wherein the first exterior sole component extends from a toe region of the article of footwear to a heel region of the article of footwear.

Clause 17: A sustainable system for an article of footwear comprising: a first article of footwear comprising: a first knitted upper component at least partially defining an interior chamber configured to receive a wearer's foot, the first knitted upper component having a lower portion configured to extend under the wearer's foot and having knit strips defining a plurality of openings; and a first midsole component received in the interior chamber of the first knitted upper component and having a first plurality of protrusions extending through the plurality of openings in the first knitted upper component; and a second article of footwear comprising: the first knitted upper component removed from the first article of footwear; and a second midsole component received in the interior chamber of the first knitted upper component and having a second plurality of protrusions extending through the plurality of openings in the first knitted upper component.

Clause 18: The sustainable system of clause 17, wherein the second midsole component is made from recycled thermoplastic polymer material.

Clause 19: The sustainable system of any of clauses 17-18, wherein the first knitted upper component is formed of yarns recycled from another knitted upper component.

Clause 20: The sustainable system of any of clauses 17-19, wherein the first article of footwear comprises a first exterior sole component configured to extend under at least part of the lower portion of the first knitted upper component and having at least one opening through which one or more protrusions within the plurality of protrusions of the first midsole component extend.

Clause 21: The sustainable system of clause 20, wherein first exterior sole component extends under at least a toe region of the knitted upper component.

Clause 22: The sustainable system of any of clauses 17-21, wherein the first knitted upper component is joined to the first midsole component in a first instance without adhesives and is joined to the second midsole component in a second instance without adhesives.

Clause 23: An array of articles of footwear, each article of footwear in the array comprising: a knitted upper component including an underfoot portion defining a plurality of openings, the plurality of openings including: (i) a first opening and (ii) a second opening separated from the first opening by a knit strip of upper component material, wherein the knitted upper component at least partially defines an interior chamber configured to receive a wearer's foot; and a midsole component received in the interior chamber of the upper component, the midsole component having a plurality of protrusions including (i) a first protrusion extending through the first opening and (ii) a second protrusion extending through the second opening, wherein the knit strip of the upper component material covers a portion of the midsole component located in a recess between the first protrusion and the second protrusion, wherein among all articles of footwear included in the array, the widths of the knit strips include a standard deviation of less than 1.2 millimeters.

Clause 24: The array of articles of footwear of clause 23, wherein the knitted upper component includes an overfoot knit panel having a length from an ankle opening to an anterior portion of a toe region, wherein among all articles of footwear included in the array, the lengths of the overfoot knit panel include a standard deviation within a range of 3 millimeters and 6 millimeters.

Clause 25: The array of articles of footwear of any of clauses 23-24, wherein the midsole component and the knitted upper component are joined together without adhesives.

Clause 26: The array of articles of footwear of any of the clauses 23-25, wherein the first protrusion and the second protrusion each include a side wall defining the recess, wherein the side wall is a continuous surface.

Clause 27: A knitted upper component for an article of footwear, the knitted upper component comprising: a medial side; a lateral side; a toe region comprising an anterior portion configured to, in the article of footwear, overlap with a sole structure of the article of footwear; a medial knit panel forming at least part of the medial side, the medial knit panel comprising a medial-panel top edge that terminates in the anterior portion of the toe region; a lateral knit panel forming at least part of the lateral side, the lateral knit panel comprising a lateral-panel top edge that terminates in the anterior portion of the toe region; and an overfoot knit panel positioned between the medial knit panel and the lateral knit panel and extending from the toe region to an ankle opening, the overfoot knit panel comprising: an overfoot-panel lateral edge that terminates and intersects the lateral-panel top edge at a first edge intersection in the anterior portion of the toe region; and an overfoot-panel medial edge that terminates and intersects the medial-panel top edge at a second edge intersection in the anterior portion of the toe region.

Clause 28: The knitted upper component of clause 27, wherein a first end of the medial-panel top edge and a first end of the lateral-panel top edge that each overlap with the sole structure in the anterior portion of the toe region.

Clause 29: The knitted upper component of any of clauses 27-28, wherein the lateral knit panel and the medial knit panel each partially overlap the overfoot knit panel portion.

Clause 30: The knitted upper component of any of clauses 27-29, wherein the overfoot knit panel, the lateral knit panel, and the medial knit panel are integrally knitted together.

Clause 31: The knitted upper component of any of clauses 27-30, wherein overfoot knit panel is integrally knit to the lateral knit panel and the medial knit panel along a quantity of courses in the anterior portion of the toe region, the quantity of courses being between 2 and 8.

Clause 32: The knitted upper component of any of the clauses 27-31, wherein courses joining the overfoot knit panel, the lateral knit panel, and the medial knit panel comprise a single jersey knit structure.

Clause 33: The knitted upper component of any of the clauses 27-32, wherein each of the overfoot knit panel, the lateral knit panel, and the medial knit panel comprise a double jersey knit structure outside of the courses joining the overfoot knit panel, the lateral knit panel, and the medial knit panel.

Clause 34: The knitted upper component of any of clauses 27-33, wherein the medial knit panel and the lateral knit panel each extend through a midfoot region and a heel region.

Clause 35: The knitted upper component of any of clauses 27-34, wherein the medial knit panel and the lateral knit panel are joined together in the heel region.

Clause 36: The knitted upper component of any of clauses 27-35, further comprising a lower knit panel configured to extend at least partially underfoot.

Clause 37: The knitted upper component of clause 36, wherein the lower knit panel is integrally knit with the medial knit panel and the lateral knit panel in the toe region, the midfoot region, and the heel region.

Clause 38: The knitted upper component of any of clauses 36-37, wherein the lower knit panel is integrally knit with the overfoot knit panel in at least part of the anterior portion of the toe region.

Clause 39: The knitted upper component of any of clauses 27-38, wherein the overfoot knit panel is secured to each of the medial knit panel and the lateral knit panel through one or more laces.

Clause 40: The knitted upper component of any of clauses 27-39, further comprising a first pleat integrally knit near the first edge intersection, and a second pleat integrally knit near the second edge intersection.

Clause 41: An article of footwear comprising the knitted upper component of any of clauses 27-40, and a sole structure coupled to the knitted upper component.

Clause 42: The article of footwear of clause 41, wherein the sole structure comprises a midsole component positioned within a foot-receiving void formed by the knitted upper component.

Clause 43: The article of footwear of clause 42, wherein the sole structure further comprises an exterior sole component that is positioned below the knitted upper component and the midsole component.

Clause 44: The article of footwear of clause 43, wherein the exterior sole component is at least partially wrapped around the medial knit panel and the lateral knit panel of the knitted upper component.

Clause 45: The article of footwear of any of clauses 43-44, wherein the exterior sole component overlaps at least part of the anterior portion of the toe region of the knitted upper component.

Clause 46: The article of footwear of any clauses 43-45, wherein each of the knitted upper component, the midsole component, and exterior sole component are made exclusively of recyclable material.

Clause 47: A knitted upper component for an article of footwear, the knitted upper component comprising: a medial side; a lateral side; a toe region; a medial knit panel forming at least part of the medial side; a lateral knit panel forming at least part of the lateral side; an overfoot knit panel positioned between the medial knit panel and the lateral knit panel and extending from the toe region to an ankle opening; a lateral pleat within the toe region, the lateral pleat being formed by the lateral knit panel being integrally knit with and overlapping the overfoot knit panel; and a medial pleat within the toe region, the medial pleat being formed by the medial knit panel being integrally knit with and overlapping the overfoot knit panel.

Clause 48: The knitted upper component of clause 27 wherein the medial pleat and the lateral pleat are positioned entirely within the toe region.

Clause 49: The knitted upper component of any of clauses 47-48, wherein the medial pleat and the lateral pleat are each at least partially positioned within an anterior portion of the toe region, the anterior portion of the toe region being configured to, in the article of footwear, overlap with a sole structure of the article of footwear.

Clause 50: The knitted upper component of any of clauses 47-49, further comprising a lower knit panel, at least part of the lower knit panel being configured to extend underfoot of a wearer.

Clause 51: The knitted upper component of clause 50, wherein the lateral pleat and the medial pleat each extend from a boundary between the lower knit panel and the overfoot knit panel.

Clause 52: The knitted upper component of any of clauses 50-51, wherein the lower knit panel is integrally knit with the medial knit panel and the lateral knit panel in at least the toe region and the midfoot region.

Clause 53: The knitted upper component of any of clauses 47-52, wherein the overfoot knit panel is integrally knit to the lateral knit panel and to the medial knit panel along a quantity of courses to form the lateral pleat and the medial pleat, the quantity of courses being between 2 and 8.

Clause 54: The knitted upper component of any of clauses 47-53, wherein courses joining the overfoot knit panel, the lateral knit panel, and the medial knit panel comprise a single jersey knit structure.

Clause 55: The knitted upper component of any of clauses 47-54, wherein each of the overfoot knit panel, the lateral knit panel, and the medial knit panel comprise a double jersey knit structure outside of the courses joining the overfoot knit panel, the lateral knit panel, and the medial knit panel.

Clause 56: The knitted upper component of any of clauses 47-55, wherein the lateral pleat and the medial pleat are the only raised structures in an anterior portion of the toe region of the knitted upper component.

Clause 57: The knitted upper component of any of clauses 47-56, wherein the medial knit panel and the lateral knit panel each extend through a midfoot region and a heel region.

Clause 58: An article of footwear comprising the knitted upper component of any of clauses 27-58 and a sole structure coupled to the knitted upper component.

Clause 59: The article of footwear of clause 58, wherein the sole structure comprises a midsole component and an exterior sole component, the midsole component being positioned within a foot-receiving void formed by the knitted upper component, and the exterior sole component positioned below the knitted upper component and the midsole component.

Clause 60: The article of footwear of clause 59, wherein the exterior sole component is at least partially wrapped around the medial knit panel and the lateral knit panel of the knitted upper component.

Clause 61: The article of footwear of any of clauses 59-60, wherein the exterior sole component overlaps at least part of the anterior portion of the toe region of the knitted upper component.

Clause 62: The article of footwear of any of clauses 59-61, wherein each of the knitted upper component, the midsole component, and exterior sole component are made exclusively of recyclable material.

Clause 63: A method of manufacturing a knitted upper component, the method comprising: forming a lateral knit panel on at least one of a first needle bed and a second needle bed; forming a medial knit panel on at least one of the first needle bed and the second needle bed; transferring loops from the second needle bed to the first needle bed; shifting the first needle bed relative to the second needle bed in a first direction by a number of needle positions; knitting a quantity of courses on only the first needle bed; transferring loops from the first needle bed to the second needle bed; knitting a second quantity of courses on only the second needle bed; shifting the first needle bed relative to the second needle in a second direction by the number of needle positons, the second direction being opposite the first direction; and forming an overfoot knit panel on at least one of the first needle bed and the second needle bed.

Clause 64: The method of manufacturing of clause 63, wherein the overfoot knit panel is knit on both the first needle bed and the second needle bed.

Clause 65: The method of manufacturing of any of clauses 63-64, wherein the lateral knit panel and the medial knit panel are each knit on both the first needle bed and the second needle bed.

Clause 66: The method of manufacturing of any of claims clauses 63-65, wherein the first quantity of courses is the same as the second quantity of courses.

Clause 67: The method of manufacturing of any of clauses 63-66, wherein the first quantity of courses and the second quantity of courses are each within a range of 1 to 5.

Clause 68: The method of manufacturing of any of clauses 63-66, wherein the first quantity of courses and the second quantity of courses are each 2.

Clause 69: The method of manufacturing of any of clauses 63-68, wherein portions of the lateral knit panel and the medial knit panel configured to form a heel region of the knitted upper component are formed before portions of the lateral knit panel and the medial knit panel configured to form a toe region of knitted upper component.

Clause 70: The method of manufacturing of any of clauses 63-69, wherein the lateral knit panel and the medial knit panel are knit at the same time.

Clause 71: The method of manufacturing of any of clauses 63-70, further comprising knitting a lower knit panel configured to form an underfoot portion of the knitted upper component.

Clause 72: The method of manufacturing of clause 71, wherein the lower knit panel is knit at the same time as the lateral knit panel and the medial knit panel and is at least partially formed of courses that are continuous with the lateral knit panel and the medial knit panel.

Clause 73: The method of manufacturing of any of clauses 63-72, wherein the quantity of needle positions is within a range of 4 to 12.

Clause 74: The method of manufacturing of any of clauses 63-72, wherein the quantity of needle positions is 8.

Clause 75: An article of footwear, comprising: a knitted upper component forming an instep region and having a plurality of lace apertures; and an exterior sole component coupled to the knitted upper component, the exterior sole component forming a ground-contacting surface of the article of footwear, the exterior sole component comprising: a first top edge portion located along the instep region on a medial side of the knitted upper component, the first top edge portion including a first lace-engaging component, a second top edge portion located along the instep region on a lateral side of the knitted upper component, the second top edge portion including a second lace-engaging component;

and an intermediate portion forming at least part of the ground contacting surface and extending between the first top edge portion and the second top edge portion.

Clause 76: The article of footwear of clause 75, wherein the plurality of lace apertures comprises a plurality of integrally knitted lace apertures.

Clause 77: The article of footwear of any of clauses 75-76, wherein the plurality of lace apertures comprises a plurality of raised tubular structures each having a channel configured to receive a lace.

Clause 78: The article of footwear of any of clauses 75-77, further comprising a midsole component coupled to the knitted upper component.

Clause 79: The article of footwear of clause 78, wherein the midsole component comprises a plurality of protrusions and wherein the exterior sole component includes a plurality of openings, the plurality of protrusions of the midsole component extending through the plurality of openings of the exterior sole portion.

Clause 80: The article of footwear of clause 79, wherein knitted upper component comprises a bottom portion having strips defining a plurality of openings, the plurality of protrusions of the midsole component extending through the plurality of openings of the knitted upper component.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An article of footwear, comprising:
- a knitted upper component comprising:
- a medial side;
- a lateral side;
- a medial knit panel forming at least part of the medial side of the knitted upper component and having a medial-panel top edge;
- a lateral knit panel forming at least part of the lateral side of the knitted upper component having a lateral-panel top edge;
- an overfoot knit panel positioned between the medial knit panel and the lateral knit panel; and
- a plurality of lace tunnels comprising:
- at least a first lace tunnel positioned on the overfoot knit panel,
- at least a second lace tunnel positioned adjacent to the medial-panel top edge of the medial knit panel, and
- at least a third lace tunnel positioned adjacent to the lateral-panel top edge of the lateral knit panel; and
- a sole component that extends onto the medial side and onto the lateral side, and that includes a plurality of lace openings.

2. The article of footwear of claim 1, further comprising a lace extending through each lace tunnel of the plurality of lace tunnels.

3. The article of footwear of claim 2, wherein a single lace extends through the each lace tunnel of the plurality of lace tunnels.

4. The article of footwear of claim 1, further comprising a midsole component positioned within an interior void formed by the knitted upper component.

5. The article of footwear of claim 4, wherein a lower portion of the knitted upper component includes apertures, wherein protrusions extending from a bottom side the midsole component extend through the apertures in the lower portion of the knitted upper component.

6. The article of footwear of claim 4, wherein the midsole component and the knitted upper component are joined together without adhesives.

7. The article of footwear of claim 1, wherein the plurality of lace tunnels are integrally knit with one or more portions of the knitted upper component.

8. The article of footwear of claim 1, wherein the medial knit panel, the lateral knit panel, and the overfoot knit panel are integrally knit in a unitary construction.

9. A knitted upper component for an article of footwear, the knitted upper component comprising:
- a medial side;
- a lateral side;
- a toe region;
- a medial knit panel forming at least part of the medial side;
- a lateral knit panel forming at least part of the lateral side;
- an overfoot knit panel positioned between the medial knit panel and the lateral knit panel and extending from the toe region to an ankle opening;
- a lateral pleat within the toe region, the lateral pleat being formed by the lateral knit panel being integrally knit with and overlapping the overfoot knit panel; and
- a medial pleat within the toe region, the medial pleat being formed by the medial knit panel being integrally knit with and overlapping the overfoot knit panel.

10. The knitted upper component of claim 9, wherein the medial pleat and the lateral pleat are positioned entirely within the toe region.

11. The knitted upper component of claim 9, wherein the medial pleat and the lateral pleat are each at least partially positioned within an anterior portion of the toe region, the anterior portion of the toe region being configured to, in the article of footwear, overlap with a sole structure of the article of footwear.

12. The knitted upper component of claim 9, further comprising a lower knit panel, at least part of the lower knit panel being configured to extend underfoot of a wearer.

13. The knitted upper component of claim 12, wherein the lateral pleat and the medial pleat each extend from a boundary between the lower knit panel and the overfoot knit panel.

14. The knitted upper component of claim 12, wherein the lower knit panel is integrally knit with the medial knit panel and the lateral knit panel in at least the toe region and a midfoot region.

15. The knitted upper component of claim 9, wherein the overfoot knit panel is integrally knit to the lateral knit panel and to the medial knit panel along a quantity of courses to form the lateral pleat and the medial pleat, the quantity of courses being between 2 and 8.

16. The knitted upper component of claim 9, wherein courses joining the overfoot knit panel, the lateral knit panel, and the medial knit panel comprise a single jersey knit structure.

17. The knitted upper component of claim 16, wherein each of the overfoot knit panel, the lateral knit panel, and the medial knit panel comprise a double jersey knit structure outside of the courses joining the overfoot knit panel, the lateral knit panel, and the medial knit panel.

18. The knitted upper component of claim 9, wherein the lateral pleat and the medial pleat are raised structures in an anterior portion of the toe region of the knitted upper component.

19. The knitted upper component of claim 9, wherein the medial knit panel and the lateral knit panel each extend through a midfoot region and a heel region.

20. An article of footwear comprising the knitted upper component of claim 9 and a sole structure coupled to the knitted upper component.

21. The article of footwear of claim 20, wherein the sole structure comprises a midsole component and an exterior sole component, the midsole component being positioned within a foot-receiving void formed by the knitted upper component, and the exterior sole component positioned below the knitted upper component and the midsole component.

22. The article of footwear of claim 21, wherein the exterior sole component overlaps at least part of an anterior portion of the toe region of the knitted upper component.

23. The article of footwear of claim 21, wherein the exterior sole component is at least partially wrapped around the medial knit panel and the lateral knit panel of the knitted upper component.

24. The article of footwear of claim 21, wherein each of the knitted upper component, the midsole component, and the exterior sole component are made exclusively of recyclable material.

* * * * *